United States Patent [19]

Wyman

[11] Patent Number: 4,855,079

[45] **Date of Patent: * Aug. 8, 1989**

[54] SUPER PARAMAGNETIC FLUIDS AND METHODS OF MAKING SUPER PARAMAGNETIC FLUIDS

[75] Inventor: John E. Wyman, Westford, Mass.

[73] Assignees: Hitachi Metals, Ltd., Tokyo, Japan; Consolidated Chemical & Consulting Co., Westford, Mass.

[ * ] Notice: The portion of the term of this patent subsequent to Oct. 20, 2004 has been disclaimed.

[21] Appl. No.: 89,853

[22] Filed: Aug. 27, 1987

Related U.S. Application Data

[63] Continuation-in-part of Ser. No. 925,248, Oct. 31, 1986, Pat. No. 4,701,276.

[51] Int. Cl.[4] ..... H01F 1/25; H01F 10/10

[52] U.S. Cl. ..... 252/62.52; 252/62.51; 252/62.53; 427/127

[58] Field of Search ..... 252/62.52, 62.53, 62.51; 427/127

[56] References Cited

U.S. PATENT DOCUMENTS

| | | | |
|---|---|---|---|
| 3,215,572 | 11/1965 | Papell | 149/2 |
| 3,387,993 | 6/1968 | Flowers | 252/62.53 |
| 3,531,413 | 9/1970 | Rosensweig | 252/62.62 |
| 3,700,595 | 10/1972 | Kaiser | 252/62.56 |
| 3,764,540 | 10/1973 | Khalafalla et al. | 252/62.55 |
| 3,843,540 | 10/1974 | Reimers et al. | 252/62.52 |
| 3,917,538 | 11/1975 | Rosensweig | 252/62.51 |
| 4,094,804 | 6/1978 | Shimoiizaka | 252/62.52 |
| 4,208,294 | 6/1980 | Khalafalla et al. | 252/62.52 |
| 4,253,886 | 3/1981 | Aonuma et al. | 252/62.51 |
| 4,285,801 | 8/1981 | Chiang | 252/62.51 |
| 4,315,827 | 2/1982 | Bottenberg et al. | 252/62.51 |
| 4,322,474 | 3/1982 | Matsuura et al. | 252/62.54 |
| 4,331,654 | 6/1980 | Morris | 252/62.53 |
| 4,333,988 | 6/1982 | Yamada et al. | 252/62.54 |
| 4,430,239 | 2/1984 | Wyman | 252/62.51 |
| 4,485,024 | 11/1984 | Furumura et al. | 252/62.56 |
| 4,554,220 | 11/1985 | Yamamoto et al. | 252/62.51 |
| 4,604,222 | 8/1986 | Borduz et al. | 252/62.52 |
| 4,608,186 | 8/1986 | Wakayama et al. | 252/62.52 |
| 4,626,370 | 12/1986 | Wakayama et al. | 252/62.52 |
| 4,701,276 | 10/1987 | Wyman | 252/62.52 |
| 4,741,850 | 5/1988 | Wyman | 252/62.52 |

OTHER PUBLICATIONS

Rosensweig, R. E., Magnetic Fluids, International Science and Technology, pp. 48–56 (Jul. 1966).

Kaiser, R. and Miskolczy, G., Magnetic Properties of Stable Dispersions of Subdomain Magnetite Particles, Journal of Applied Physics, vol. 41, No. 3, Mar. 1, 1970.

*Primary Examiner*—John F. Niebling
*Assistant Examiner*—Steven P. Marguis
*Attorney, Agent, or Firm*—Finnegan, Henderson, Farabow, Garrett and Dunner

[57] ABSTRACT

Super paramagnetic fluids having improved thermal and oxidative stability and processes for making super paramagnetic fluids having improved thermal and oxidative stability.

28 Claims, No Drawings

SUPER PARAMAGNETIC FLUIDS AND METHODS OF MAKING SUPER PARAMAGNETIC FLUIDS

BACKGROUND OF THE INVENTION

This is a Continuation-In-Part application of application Ser. No. 925,248 filed Oct. 31, 1986 now U.S. Pat. No. 4,701,276 filed 10-20-87.

1. Field of the Invention

The present invention relates to super paramagnetic fluids, of the type usually referred to as ferrofluids, having improved thermal and oxidative stability and to a process for making super paramagnetic fluids having improved thermal and oxidative stability.

2. Description of Related Art

Super paramagnetic fluids, which are subsequently referred to as magnetic fluids, are colloidal suspensions of magnetic particles in a carrier liquid. The magnetic particles are suspended in the carrier liquid by a dispersing agent which attaches to the surface of the magnetic particles to physically separate the particles from each other. Dispersing agents are molecules which have a polar "head" or anchor group which attaches to the magnetic particle and a "tail" portion which extends outwardly from the particle surface. The carrier liquid must be a thermodynamically good solvent for the tail portion of the dispersing agent in order to produce a stable ideal colloid of magnetic particles in the carrier liquid.

Magnetic fluids have a wide variety of industrial and scientific applications which are well known to those of ordinary skill in the art. Specific uses of magnetic liquids which illustrate the present invention and its advantages include the use of magnetic liquids as components of exclusion seals for computer disc drives, seals for bearings, for pressure and vacuum sealing devices, for heat transfer and damping fluids in audio speaker devices, and for inertia damping.

Ideally, magnetic fluids suitable for sealing disc drives for computers have a low viscosity and a low evaporation rate. These two physical characteristics of magnetic fluids are primarily determined by the physical and chemical characteristics of the carrier liquid. Magnetic particle size and size distribution and the physical and chemical characteristics of the dispersant, however, also affect viscosity and often the evaporation rate of magnetic fluids.

The characteristics of low evaporation rate and low viscosity are difficult to achieve in a magnetic fluid since carrier liquids having the lowest evaporation rate are usually liquids of high molecular weight. The viscosity of carrier liquids tends to increase as the molecular weight of the liquid increases. In addition, high molecular weight materials, whether polar or non-polar, tend to have lower solubility for the tails of dispersing agents as the molecular weight of the carrier liquid increases.

Magnetic fluids used for inertia damping and similar applications do not require a low viscosity and in fact ordinarily require a relatively high viscosity. Thermal stability of magnetic fluids used in inertia damping equipment is, however, a significant concern.

The selection of a dispersant is a critical factor in providing magnetic fluids which remain stable suspensions in the presence of a magnetic field yet which have desirable viscosity and volatility characteristics. Fatty acids, such as oleic acid, have been used as dispersing agents to stabilize magnetic particle suspensions in some low molecular weight non-polar hydrocarbon liquids such as kerosene. Use of fatty acids, however, has not proven satisfactory for dispersing magnetic particles in polar organic carrier liquids or hydrocarbon oils which are high molecular weight non-polar carrier liquids.

Magnetic fluids using polar organic carrier liquids are disclosed in U.S. Pat. No. 4,430,239 which discloses using phosphoric acid esters as dispersing agents in polar carriers such as di(2-ethylhexyl)azelate. It has been found that the magnetic fluids illustrated in U.S. Pat. No. 4,430,239, however, are thermally and oxidatively unstable at temperatures in excess of about 100° C. In fact, the temperature of the magnetic fluids described in U.S. Pat. No. 4,430,239 are ordinarily maintained below about 80° C. to ensure that the magnetic fluid remains stable. If the temperature of 100° C. is exceeded, the phosphoric acid ester dispersing agent decomposes, resulting in an unstable magnetic fluid in which the magnetic particles begin to agglomerate and precipitate out of the carrier liquid. When the magnetic fluid becomes unstable, the seal is lost since the magnetic fluid is no longer held in place by the magnetic force applied by a magnet. Accordingly, when magnetic fluids such as those illustrated in U.S. Pat. No. 4,430,239 are used in a pressure or vacuum sealing device which is exposed to a source of heat, the apparatus usually includes a cooling system which circulates a cooling liquid, such as water, to remove heat from the magnetic fluid. The need for cooling systems to maintain the magnetic fluid at a sufficiently low temperature to ensure the thermal stability of the magnetic fluid necessarily complicates the construction of the apparatus. Moreover, cooling systems are attended by problems, such as scale formation in passages carrying the coolant liquids, which require maintenance and may result in equipment failure.

The present invention provides thermally and oxidatively stable magnetic fluids. Because of the characteristics of magnetic fluids made in accordance with the present invention, temperatures in devices utilizing these magnetic fluids may exceed 100° C. without impairing significantly the stability of the magnetic fluids. Therefore, the cooling mechanisms used to cool the magnetic fluids in equipment, such as pressure or vacuum sealing devices, may not be required when magnetic fluids of the present invention are used to form the seals.

The present invention also provides a process for making magnetic fluids which are thermally and oxidatively stable and which enables one making magnetic fluids to control other magnetic fluid characteristics such as viscosity and evaporation rate.

SUMMARY OF THE INVENTION

One embodiment of the present invention is a magnetic fluid comprising (a) a carrier liquid; (b) a dispersing agent comprising a salt of an aromatic sulfonic acid which disperses coated magnetic particles in the carrier liquid; and (c) coated magnetic particles coated with at least one organic acid which renders the magnetic particle hydrophobic, the organic acid being capable of peptizing the magnetic particles into a fugitive solvent, the fugitive solvent being a solvent for the dispersing agent.

The present invention also includes a process for making a magnetic liquid comprising (a) providing an aqueous suspension of coated magnetic particles coated with an organic acid which renders the magnetic particles hydrophobic; (b) separating the coated magnetic particles from the aqueous suspension; (c) treating the coated magnetic particles with a solution of a dispersing agent in a fugitive solvent wherein the fugitive solvent is one in which the coated magnetic particles peptize into a stable colloidal suspension; and (d) adding a carrier liquid to the colloidal suspension to form a stable magnetic fluid.

Additional advantages and embodiments of the invention will be set forth in part in the description which follows, and in part will be apparent from the description, or may be learned by practice of the invention. The advantages of the invention may be realized and attained by processes, materials and combinations particularly pointed out in the appended claims.

DETAILED DESCRIPTION OF THE INVENTION

The advantages of the present invention are provided primarily by using a dispersing agent comprising a salt of an aromatic sulfonic acid for dispersing the magnetic particles coated with at least one organic acid. The performance of magnetic fluids of the present invention used in sealing applications is further enhanced when the particle size distribution of the magnetic particles suspended in the carrier fluid is narrowed to provide magnetic liquids with low viscosity.

Magnetic fluids of the present invention may contain any suitable magnetic particles including metals and metal alloys. The magnetic particles most commonly used in magnetic fluids of the present invention are magnetite, gamma iron oxide, chromium dioxide, ferrites, and various elements of metallic alloys. The preferred magnetic particles are magnetite ($Fe_3O_4$) and gamma and alpha iron oxide ($Fe_2O_3$). Magnetic particles are usually present in a magnetic liquid of the present invention from about 1% to 20%, preferably about 1% to 10% and more preferably from about 3% to 8%, by volume of the magnetic fluid.

Magnetic particles in the final magnetic fluid, such as magnetite, preferably have an average magnetic particle diameter from between about 80Å to about 90Å, although particles having larger or smaller average magnetic particle diameter may be used. Commonly used magnetic fluids ordinarily contain magnetic particles with an average magnetic particle diameter of about 105Å. Although particles having an average magnetic particle size of about 105Å may be used in present invention, restricting the average magnetic particle size to somewhere in the range of from about 80Å to 90Å has been found, in some embodiments of the present invention, to enhance the apparent stability of magnetic fluids maintained in a magnetic field gradient.

Non-polar carrier liquids useful in the present invention include hydrocarbon oils and preferably poly(alpha olefin) oils of low volatility and low viscosity. These oils are commercially available. For instance, SYNTHANE oils produced by Gulf Oil Company having viscosities of 2, 4, 6, 8 or 10 centistokes (cst.) are readily available and are useful as non-polar liquids in the present invention.

Examples of polar organic carrier liquids in which stable suspensions of magnetic particles may be formed are plasticizers for polymers such as vinyl-chloride resins, which include, but are not limited to: diesters; triesters; polyesters of saturated hydrocarbon acids, such as a $C_6$–$C_{12}$ acid; phthalates, such as dioctyl and other dialkyl phthalates; and trimellitate esters, citrate esters and particulary diesters and triesters such as di(2-ethylhexyl)azelate, diisodecyl adipate, tributyl citrate, acetyl tributyl citrate; and trimellitate esters, such as tri(n-octyl/n-decyl) or other alkyl trimellitate. Other polar organic carrier liquids include, but are not limited to, derivatives of phthalic acid, with emphasis on dialkyl and alkylbenzy orthophthalates, phosphates including triaryl, trialkyl and alkylaryl phosphates, epoxy derivatives, including epoxidized soybean oil, epoxidized tall oil, dialkyl adipates, polyesters of glycols, for example, adipic, azelaic and phthalic acids with various glycols, trimellitates, such as trialkyl trimellitates, glycol dibenzoates, pentaerythritol derivatives, chlorinated liquid paraffins, and in particular the $C_8$, $C_9$ and $C_{10}$ phthalates, such as di(2-ethylhexyl)phthalate, diisononyl phthalate, diisodecyl phthalate and di(2-ethylhexyl)terephthalate.

It has been found that magnetic particles coated with an organic acid and subsequently treated with a salt of an aromatic sulfonic acid form thermally and oxidatively stable colloidal suspensions of magnetic particles in relatively high molecular weight non-polar carrier liquids and polar organic carrier liquids. The organic acid used must render the magnetic particles hydrophobic. In addition, the organic acid must peptize the magnetic particles into a fugitive solvent, such as xylene, heptane, toluene and the like. The fugitive solvent must in turn be a solvent for the aromatic sulfonic acid salt dispersing agent. Those skilled in the art know that peptization is the spontaneous formation of a stable colloidal suspension.

Organic acids are used to coat magnetic particles in the present invention before the particles are treated with the dispersant salt of an aromatic sulfonic acid. The organic acids used to coat the magnetic particles are preferably monocarboxylic acids having from 12 to 22 carbon atoms and more preferably are fatty acids. Fatty acids suitable for use in the present invention include lauric acid, oleic acid, linoleic acid, linolenic acid, palmitic acid, myristic acid, stearic acid, isostearic acid, arachidic acid and behenic acid.

Some fatty acids, however, specifically palmitic acid, stearic acid and myristic acid, do not peptize the magnetic particles into a fugitive solvent when used alone to coat magnetic particles used in the present invention. This phenomenon is believed to occur, in part, because these three fatty acids have tail portions with a regular structure which tend to associate with each other rather than dissolve in the fugitive solvent. As the tail portions of the organic acid associate with each other, they collapse toward the particle surface thereby reducing the distance between the particles. When the ratio of the length of the tail portion dissolved in the fugitive solvent, ($\delta$), to the magnetic particle diameter, (D), becomes less than about 0.2, the particles will agglomerate. This problem can be overcome, however, by using a mixture of organic acids to coat the magnetic particles. A mixture of several acids may be used but typically the mixture of acids contains two acids. Equal quantities of the two acids may be used but, in one embodiment of the present invention, the combination of acids comprises a first acid and a second acid where the first acid makes up a larger portion of the combination of acids than the second acid. In this embodiment of the invention, the first acid ordinarily makes up about 55% to 95%, preferably about 70% to 80%, of the volume of the combination of two acids and the second acid makes up about 5% to 45%, preferably about 20% to 30%, of the volume of the combination of acids.

In one embodiment of the present invention, magnetic particles are coated with a combination of oleic acid and palmitic acid. In this embodiment, oleic acid makes up about 5% to 45% by volume of the combination of two acids and palmitic acid makes up about 55% to 95% of the combination of acids used to coat the magnetic particles. Preferably, the oleic acid is from about 20% to 30% by volume of the combination of acids and palmitic acid is from about 70% to 80% by volume of the combination of acids. The same ratio of acids has been found useful when oleic acid is used with myristic acid.

To determine whether two acids are needed to properly coat magnetic particles used in the present invention, one first precipitates the magnetic particles, such as magnetite, in an aqueous suspension. The precipitated particles are then contacted with an acid to coat the particles. The coated particles are then combined with a fugitive solvent which is selected to be a solvent for the sulfonic acid salt dispersant to determine whether or not a stable suspension of coated particles is formed in the selected fugitive solvent. If a stable suspension is formed in the fugitive solvent, of additional acid is required. If, however, a stable suspension of coated particles in the fugitive solvent is not formed, it will be necessary to coat the magnetic particles with a combination of acids including the first acid tested and a second acid. It has been found that acids useful as the second acid are those which, when coated alone on the particles, by themselves form a stable suspension of magnetic particles in the fugitive solvent; i.e., the second acid peptizes the magnetic particles in the fugitive solvent. Organic acids having other characteristics, however, may prove useful as the second coating acid.

Oleic acid and isostearic acid are examples of suitable acids useful as second acids in the present invention. Oleic acid is believed to be more soluble than myristic, palmitic or stearic acid in fugitive solvents, such as xylene, because the double bond in oleic acid creates an irregularity in the physical structure of the acid which prevents close association of the tail portions and allows the acid tails to be dissolved by the fugitive solvent. Isostearic acid is sufficiently irregular in structure to inhibit close association of the tail portions thereof because of the pendant methyl group on the 17 carbon chain of this acid.

Dispersants used in the present invention include salts of aromatic sulfonic acids defined by the following formula:

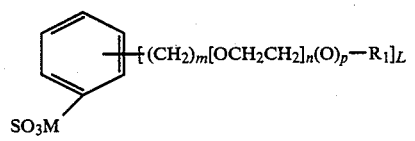

wherein:

L=1, 2, 3 or 4;

m=0–10;

n=0–15;

p=0 or 1;

M=$Na^+$, $K^+$, $Ca^{++}$, $Sr^{++}$ or an

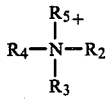

group;

$R_1$=hydrogen, an alkyl, or an alkylated aromatic group; and $R_2$, $R_3$, $R_4$ and $R_5$=hydrogen or an alkyl group.

The L groups defined by the foregoing formula may be the same or different.

To select a dispersant for a particular carrier liquid, one of ordinary skill in the art will be guided by general principles of solubility such as the general rule that "like dissolve like." In addition, a person of ordinary skill in the art will know how to evaluate other characteristics of dispersant tails, such as molecular weight, which affect solubility. In the above formula the dispersant "tail" is represented by the L substituent.

In the present invention, however, for non-polar carrier liquids, L is preferably 1 or 2; m, n and p are preferably O; $R_1$ is preferably a $C_{1-25}$ alkyl group and M is preferably $Na^+$.

When a polar carrier liquid is to be used, n may be 1–10 to provide the dispersant with a polar tail that will be dissolved by the polar liquid carrier and cause the coated magnetic particles to disperse into the polar liquid carrier. Other salts of aromatic sulfonic acids which may be useful as dispersants in polar organic carrier liquids in accordance with the present invention have polar tail portions illustrated by the following formulas:

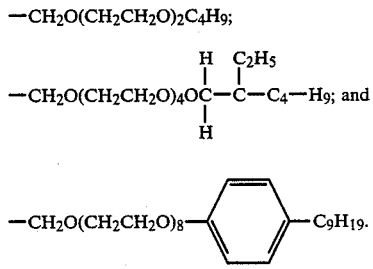

In the process used to make magnetic fluids of the present invention, magnetic particles are precipitated from a solution of metallic salts to form an aqueous slurry and then coated with an organic acid. Fugitive solvent is added to the aqueous slurry of coated magnetic particles in an amount sufficient to coagulate the particles into a water repellant granular mass to separate quickly the coated magnetic particles from the water.

The addition of fugitive solvent apparently makes the tail portion of the coating acid or acids sticky which causes the coated particles to agglomerate and precipitate into a granular mass from which the water may be poured away. Use of sufficient fugitive solvent to coagulate the coated magnetic particles into a water repellant granular mass eliminates emulsification problems encountered with conventional processes where dispersantcoated particles are peptized directly into a coating liquid in the presence of water.

The fugitive solvent is one in which the organic acid tail portion is soluble and the dispersing agent is soluble in the fugitive solvent. Fugitive solvents useful in the present invention include xylene, heptane, kerosene and the like. For polar organic carrier liquids, xylene is a preferred fugitive solvent while heptane is a preferred fugitive solvent for non-polar organic liquid carriers.

After the coated magnetic particles have agglomerated, they are separated from the water, usually by pouring the water off, and then washed repeatedly with water. Acetone is added to the washed particles to remove any water which may be entrained on the coated particles. Additional fugitive solvent, such as xylene, kerosene, heptane and the like, is then added to the coated particles to form a suspension of coated magnetic particles. The fugitive solvent added at this stage is preferably the same as the fugitive solvent used earlier in the process to get the coated particles out of the water but it is not necessarily the same as the fugitive solvent used to separate the coated magnetic particles from the water.

The suspension of magnetic particles in the fugitive solvent is then treated with a salt of an aromatic sulfonic acid. It is believed that salts of aromatic sulfonic acids prevent the complete collapse of the organic acid used to coat the particles when the coated and treated particles are contacted by a carrier liquid. Treating coated magnetic particles with a salt of an aromatic sulfonic acid therefore renders the magnetic particles more stably suspended in high molecular weight carrier liquids. The process of making magnetic fluids of the present invention is illustrated in more detail in the ensuing paragraphs and examples.

The preferred method of precipitating magnetic particles, in this instance, magnetite, is described by the following formula: $FeSO_4+2FeCl_3+8NH_4OH \rightarrow Fe_3O_4+(NH_4)_2SO_4+6NH_4Cl+4H_2O$ The stoichiometric ratio of $Fe^{+3}/Fe^{+2}$ is 2:1. It is generally believed that if this ratio is less than 2:1 a considerable quantity of non-magnetic material will be formed. Good yields of magnetic product may be obtained, however, if the molar ratio of $Fe^{+3}/Fe^{+2}$ measured for use in the process of the present invention is about 1.93/1.00. This apparently occurs because a certain amount of the ferrous salt is oxidized during normal handling in air. This oxidation reduces the amount of ferrous salt available for reaction and increases the amount of ferric salt. No attempt therefore needs to be made to prevent contact of the ferrous salt with air when solid ferrous salt is weighed and dissolved in the ferric chloride solution. A deliberate excess of ferric salt should be avoided, however, since ferric hydroxide gel will usually form which might be difficult to wash out of the reaction mixture.

It does not appear necessary to control accurately the rate of addition of the iron salt solution to the ammonia solution. Pouring the iron salt in slowly over about a 30 second time period is usually acceptable. A mixture of ferrous hydroxide and ferric hydroxide gels forms initially. As the mixture is stirred, the gel breaks up, turns black, and the reaction mixture heats up from about 25° C. to about 60° C. Most of the heat is evolved as the mixture of hydrated oxides rearranges to the spinel structure of the magnetite.

The reaction mixture needs to be stirred for only about 15 minutes after complete addition of the iron salt. When the conversion to the spinel structure occurs, usually at a final temperature of about 60° C., the lumps of gel disappear in less than 2–3 minutes and a smooth black dispersion of magnetite in water is formed.

The organic acid used to coat magnetite can be added in one of two ways. If one acid alone is used, such as oleic acid, the liquid organic acid can be poured into the vortex formed by rapid mechanical stirring of the reaction mixture. Then, stirring for an additional fifteen minutes allows the organic acid to dissolve in the ammoniacal solution so that it is transported through the aqueous medium to deposit on the surface of the magnetite.

Alternatively, if a combination of acids is used, such as 70% myristic acid and 30% oleic acid, the acids are preferably first melted and mixed together and then dissolved in strong aqueous ammonia. The resulting ammonium soap solution is heated to about 90° C. and then added to the magnetite slurry. This procedure ensures that there is no preferential deposition of one acid at the expense of another.

A precise amount of a non-polar organic liquid, such as heptane, is added to aid in getting the acid coated magnetic particles out of the water. Separating the coated magnetic particles from water as thoroughly as possible is important to the process of the present invention in order to prevent catalyzed oxidation of the magnetite to ferric oxide.

The correct quantity of heptane is used to cause the coated magnetite to coagulate into a water repellant granular mass. Addition of too much heptane will cause the formation of a viscous, oily mass which emulsifies some of the reaction mixture with the by-product salts which are then extremely difficult to wash out. Too little heptane produces a light, powdery mass which is slow to settle even under the influence of a magnet. Stirring the reaction mixture with the heptane for about 10–15 minutes causes the coated magnetite to settle to the bottom of the beaker.

Placing a large Alnico 5 horseshoe magnet along the side of the beaker holds the coated magnetite in place as the beaker is tipped to allow the water to run out. The aqueous phase is removed almost completely, and the beaker is refilled with water and stirred before it is drained again. Experience has shown that usually three washes is adequate to remove impurities. Any excess ferric hydroxide gel tends to absorb on the coated magnetite particles. However, the excess ferric hydroxide is washed off the particles by the rinse water and appears to remain suspended in the rinse water long enough to be drained out of the beaker. As a rule, three water washes are sufficient but in any event, washing should be continued until the rinse water is clear and free from suspended solids.

The coated particles at this point ordinarily still contain some water. Most of the remaining water can be easily removed by stirring the particles with acetone. After stirring the particles with acetone, they are collected over a magnet and as much of the acetone as possible is drained off. Preferably, two sequential acetone washes are used. Heptane is then added to the coated particles to form a slurry and the slurry is heated to evaporate acetone and any residual water. The heptane slurry is then placed in a shallow aluminum pan over a strong magnet for about one hour to remove particles which are too large to be stabilized by the oleic acid.

The addition of acetone effectively removes almost all of the water before the addition of a large quantity of organic solvent such as heptane or xylene which is immiscible with water. The process outlined above eliminates problems, such as emulsification, which are encountered when the organic solvent is added to the coated magnetite suspended in water or the aqueous reaction mixture.

The magnetic colloid in heptane is removed from the pan without taking the pan off the magnet. As much of the liquid as possible is scooped out by a small beaker and filtered into a pan. The residual material is washed 5 times with 200 ml. portions of heptane. Unstabilized particles are held strongly on the bottom of the pan by the magnet. Any residual stable magnetic colloid is diluted by the heptane so that it is only weakly held by the magnet and can be poured out of the pan. The coated magnetite forms a stable colloid in heptane and it is now free from large, unstable particles as well as any inorganic salt byproduct which might not have been eliminated by water washing.

The coated magnetic particles dispersed in heptane are then treated with the salt of an aromatic sulfonic acid, preferably a petroleum sulfonate salt when a hydrocarbon oil is the carrier liquid. The petroleum sulfonate salt is usually purchased as a solution in mineral oil. Representative materials are the "PETROSULS" from Pennreco Co. and "PETRONATES" from Witco Co. In order to make the petroleum sulfonate salt available to attach to and stabilize the coated magnetite particles, the petroleum sulfonate salt is dissolved in heptane and heated to eliminate micellar water and to free the dispersant from micelles. Experience has shown that heating the heptane/petroleum sulfonate salt mixture to 90° C. is sufficient.

The heptane suspension is combined with the heptane solution of the petroleum sulfonate salt to form a stable colloid and the resulting stable colloid is concentrated to about one liter volume by evaporation.

At this point it is necessary to separate the dispersant treated magnetite particles from any excess of petroleum sulfonate salt which may have been used, as well as from the mineral oil in which the petroleum sulfonate salt was dissolved. This is accomplished by adding to the heptane suspension twice its volume of acetone. The acetone causes the coated particles to agglomerate and settle so that they can be easily collected in a pan held over a magnet. The acetone/heptane solvent mixture dissolves the excess dispersant and mineral oil. It is removed from the particles which are squeezed as dry as possible with a spatula.

The particles are resuspended in heptane, heated to evaporate residual acetone, then precipitated with acetone as before. This process can be repeated just as often as desired and the dispersant absorbed on the magnetite particles is not washed off. If the acetone/heptane solvent mixture is removed as completely as possible from the precipitated particles it is probably necessary to repeat this purification process only twice.

The purified, dispersant treated magnetite particles are suspended in heptane and heated to evaporate residual acetone. Then, the carrier liquid, in this instance a hydrocarbon oil, is added to the mixture and heated to remove heptane. The finished colloid is placed in a pan over a magnet in an oven heated to about 70° C. for at least 12 hours. The elevated temperature lowers the viscosity so that particles which, although they are stable in heptane, are too large to be stabilized in the hydrocarbon carrier liquid, can be removed. The refined magnetic colloid is filtered into a clean container.

For some uses of magnetic fluids, it is desirable to obtain a magnetic fluid with as low a viscosity as possible. The viscosity of a magnetic fluid, of course, is determined primarily by the viscosity of the carrier liquid. The volume occupied by magnetic particles and dispersant in the colloid is the other important factor in determining the viscosity of a magnetic fluid. It is possible, therefore, to minimize the viscosity of a particular magnetic fluid by minimizing the volume occupied by the dispersing agent.

The structure of a specific aromatic sulfonic acid salt which will be useful in polar non-ionic carrier liquids cannot be designed a priori. Several potentially useful materials must be synthesized and tested. Then, if necessary, the results of these tests can be used in a structure/property analysis and an optimum material designed. However, certain principles can be used to design the potentially useful dispersants.

A sodium petroleum sulfonate salt with a molecular weight of about 535 will disperse oleic acid coated magnetite into a 6 centistoke (cst.) poly(alpha olefin) oil to give a magnetic fluid with magnetic particles having an average magnetic particle diameter of about 88Å. The 6 cst. oil is a moderately good solvent; it is not as good a solvent as the 2 or 4 cst. oils, but certainly better than the 8 or 10 cst. oils.

Thus, an aromatic sulfonic acid salt with polar pendant groups, having about the same molecular weight as the sodium petroleum sulfonate, should be useful in a non-ionic polar carrier liquid such as di(2-ethylhexyl-)azelate. This carrier liquid is not as polar as, for example, tributyl acetyl citrate, but it is more polar than ditridecyl phthalate.

The molecular weight of the sodium benzene sulfonate portion of the molecule is about 180; the pendant alkyl groups have a molecular weight of 535–180, e.g. 355. Since each $—CH_2—$ group has a molecular weight of 14, there are approximately 25 or 26 $—CH_2—$ groups, and it is likely that there are two chains of about 12 to 13 $—CH_2—$ groups per petroleum sulfonate molecule. This would provide a molecule with about the correct length; dodecylbenzene sulfonic acid has a length of about 24Å–25Å.

One of the obvious ways to produce a thermally and oxidatively stable aromatic sulfonic acid with pendant polar groups is to sulfonate a benzyl ether. The ether side chain, therefore, should be prepared from an alcohol with an 11 or 12 atom chain. Ethoxylated alcohols such as those shown below are excellent choices.

$$R = HO—CH_2—CH_2—(O—CH_2—CH_2)—O—C_2H_5;$$

$$= HO—CH_2—CH_2—O—CH_2—CH_2—O—CH_2—\overset{\overset{C_2H_5}{|}}{C}—C_4—H_9;$$

and $$= HO—CH_2—CH_2—O—CH_2—CH_2—O—C_4H_9.$$

The benzyl ether should be prepared so that the two pendent polar groups are in one case ortho, and in another case meta, to each other as shown below.

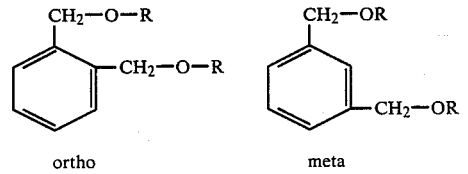

Sulfonation and neutralization with sodium hydroxide will produce the desired materials. The materials can be tested separately or in a mixture.

Should it prove necessary, longer polar side chains for use in polar liquid ester carriers that are poorer solvents than di(2-ethylhexyl)azelate can be prepared from alcohols similar to those shown above but which have a higher degree of ethoxylation. Similarly, ethoxylates of higher alcohols such as decyl, nonyl, or dodecyl alchohols could be used.

These materials are shown merely to illustrate the practice of the invention. It is not intended to limit the scope of the invention to those materials described above. Alcohols and aromatic ethers, for instance, may also be useful polar groups for use in the dispersants of the present invention.

The viscosity of a magnetic fluid is a property which is preferably controlled since viscosity affects the suitability of magnetic fluids for particular applications. The viscosity of a magnetic fluid may be predicted by principles used to describe the characteristics of ideal colloids which follow the Einstein relationship defined by the following formula:

$$N/N_o = 1 + \alpha\phi$$

wherein:

N=colloid viscosity;

$N_o$=*carrier liquid viscosity*;

$\alpha$=a known constant; and $\phi$=disperse phase volume.

The saturation magnetization of magnetic fluids is a function of the disperse phase volume of magnetic material in the magnetic fluid. In magnetic fluids, the actual disperse phase volume is equal to the phase volume of magnetic particles plus the phase volume of the attached dispersant.

In the present invention, the viscosity of the magnetic fluid is minimized by minimizing the actual disperse phase volume relative to the volume of magnetic material. In other words, to obtain a low viscosity colloid in accordance with the present invention, it is necessary to maximize the magnetic particle volume relative to the total disperse phase volume. This objective is obtained primarily by designing a dispersing agent with a tail portion of desired size. Particle size distribution cannot be ignored, however.

For instance, when using dispersants of the present invention to form magnetic fluids in non-polar hydrocarbon oil carrier liquids, in particular a 6 cst. poly(alpha olefin) oil, magnetic fluids with the following characteristics have been prepared: a magnetic fluid having a saturation magnetization of 200 gauss and a viscosity at 27° C. of 78.5 centipoise (cp.); a magnetic fluid with a saturation magnetization of 250 gauss and a viscosity at 27° C. of 91.5 cp.; a magnetic liquid with saturation magnetization of 300 gauss and a viscosity at 27° C. of about 111 cp.; and a magnetic fluid with a saturation magnetization of 400 gauss with a viscosity at 27° C. of about 172 cp.; and a magnetic fluid with a saturation magnetization of 482 gauss with a viscosity of 27° C. of about 276 cp.

To further control the properties of a magnetic fluid, it is desirable to control the average particle size and the particle size distribution of the magnetic particles in the magnetic fluid. An additional attribute of the present invention is the use of mixtures of acids to cap the size of the largest particles in the magnetic liquid. It has also been found that chelating agents may be used to remove very small particles from the precipitated particles. Both processes may be used independently of each other and are not limited to processes used to make magnetic liquids with dispersing agents comprising a salt of an aromatic sulfonic acid.

When magnetic particles, such as magnetite, are precipitated from an aqueous solution as described herein, the precipitated particles odinarily fit a log normal distribution curve with a magnetic particle diameter size range from about 30Å to about 200Å. The particles having magnetic particle diameters in excess of about 140Å typically are not stabilized in carrier liquids. Particles larger than about 140Å are therefore ordinarily removed by applying a magnetic field to the bottom of a pan in which acid-coated magnetic particles are in suspension. The larger particles which are not in stable colloidal suspension are drawn to the magnet and the particles remaining in the suspension may be poured off.

In addition to removing particles having a magnetic particle diameter in excess of about 140Å, it is possible to further restrict particle size in accordance with the present invention by selecting a coating acid or the major constituent of a combination of coating acids to further limit or cap the particle size by eliminating particles from the larger end of the log normal distribution curve.

For example, oleic acid has a measured length of about 23.5Å. The ratio of the length of the tail portion ($\delta$) of a coating acid to the diameter of the magnetic particle (D) cannot be smaller than about 0.2. Since ($\delta$) for oleic acid is known to be 23.5Å, (D), the theoretical maximum size of precipitated magnetite particles which can be stabilized in a fugitive solvent by oleic acid, is about 125Å. Accordingly, by coating the magnetic particles with oleic acid only, particles in excess of 125Å will not be present in the magnetic liquid.

To further illustrate the invention, myristic acid, a 14 carbon straight chain acid, has a length of about 18.3Å. The maximum size of particles stabilized by myristic acid in a fugitive solvent is therefore about 92Å. As pointed out previously, however, myristic acid alone cannot be used to coat magnetic particles since it is not soluble in fugitive solvents. That is, it does not peptize the magnetic particles into the fugitive solvent. In the present invention, however, myristic acid may be used to eliminate particles larger than about 92Å in magnetic particle diameter by coating the magnetic particles precipitated from an aqueous solution with a combination of acids in which myristic acid is the major constituent of the combination of acids (i.e., greater than 50% of the volume of the combination of acids) and oleic acid is the minor constituent of the combination of acids. For instance, a combination of myristic acid and oleic acid is used when one objective is to exclude from the finished magnetic fluid magnetic particles with magnetic particle diameter in excess of about 92Å. The magnetic particles precipitated from an aqueous solution should be coated with a combination of myristic acid and oleic acid in which myristic acid makes up about 30% of the volume of the combination of myristic and oleic acid and oleic acid makes up about 70% of the combination of myristic acid and oleic acid. This combination of acids has been found to peptize coated magnetic particles in fugitive solvents employed in the present invention. After the coated magnetic particles are treated with a salt of a petroleum sulfonic acid dispersant and a carrier liquid is added, the magnetic particles which were too large to be stabilized by myristic acid alone settle on a magnet and may be removed from the magnetic fluid. In this manner, it is possible to limit the range of particle sizes and the particle size distribution of magnetic particles in the present invention.

As noted previously, it is sometimes desirable to provide magnetic fluids of low viscosity for certain applications. To make a low viscosity fluid, it is desirable to remove smaller particles from the magnetic fluid, such as those smaller than about 60Å in magnetic particle diameter and particularly those smaller than about 40Å in magnetic particle diameter, since such small particles contribute to the viscosity of the magnetic liquid but do not add materially to the magnetization of the magnetic fluid. It has been found that the smaller particles of magnetic materials precipitated from an aqueous solution may be removed with a chelating agent. It is believed that the smaller magnetic particles have a higher surface energy than particles in excess of about 80Å in magnetic particle diameter and that these small particles are therefore preferentially dissolved by some chelating agents when the particles are still in the aqueous slurry before the coating acid has been added. Chelating agents which may be useful in the present invention are generally defined as derivatives and homologues of ethylenediaminetetraacetic acid. A particular chelating agent found to be useful in the present invention is "HAMPOL ACID" (N-hydroxyethyl N,N',N'-ethylenediamine triacetic acid). When added to a suspension of magnetite particles in aqueous slurry this acid is particularly effective in removing small particles such as those below 60Å in magnetic particle diameter.

The particle size distribution of particles in a magnetic fluid may be narrowed by peptizing magnetic particles which have been coated with acid and treated with a dispersing agent in accordance with the present invention into carrier liquids with solubility characteristics which permit peptizing only limited fractions of the coated and treated magnetic particles into the selected carrier liquid. For instance, if the carrier liquid initially added to magnetic particles coated and treated in accordance with the present invention, is a 10 cst. poly(alpha olefin) oil, only smaller particles, particularly those with a magnetic particle diameter below about 80Å are peptized into the 10 cst. oil. This limited peptization occurs because the 10 cst. oil is an extremely poor solvent as a result of its high molecular weight. The larger particles, those with particle diameters in excess of about 80Å agglomerate and may be held to the bottom of a pan by a magnet while the 10 cst. oil is poured off. The agglomerated particles remaining in the pan may then be contacted with a 6 cst. oil which is a reasonably good carrier liquid for the remaining magnetic particles. The 10 cst. oil remaining in the pan in conjunction with the agglomerated particles may be removed from the magnetic particles by methods known to those of ordinary skill in the art, such as repeated washings with a heptane/acetone solvent mixture.

Methods of preparing magnetic liquids in accordance with the present invention and magnetic liquids of the present invention are further illustrated by the following Detailed Procedure and Examples.

DETAILED PROCEDURE

A. Preparation of Coated Magnetite

In a 2 liter beaker is placed 470 ml. of 42° Bé ferric chloride solution, 400 ml. of water, and 278 g. of ferrous sulfate heptahydrate. The inexpensive "copperas" grade of ferrous sulfate heptahydrate may be used. The mixture is stirred using a three blade propeller driven by a variable speed electric motor until the ferrous sulfate salt is dissolved.

In a 4 liter beaker is placed 400 ml. of water and 600 ml. of 26° Bé ammonia solution. This solution is stirred vigorously with the motor driven 3 blade propeller used to mix the iron salts and the solution of the ferrous and ferric salts is added to the beaker over 30 seconds. The iron salt solution is poured into the vortex formed by the stirrer. The mixture is stirred for 15 minutes, and then 50 ml. of oleic acid is poured into the vortex formed by the stirrer. The mixture is stirred for an additional 15 minutes.

A carefully measured quantity of 53 ml. of heptane is added to the vortex formed by the stirrer and stirring is continued for an additional 10–15 minutes. The beaker is allowed to stand next to a strong magnet until the coated magnetite particles have been collected. An Alnico 5 magnet in the form of a half circle works well for this purpose. The diameter of the circle is 6 inches and each face of the magnet is 1 inch by 3 inches. As much liquid as possible is siphoned off, then the beaker is turned on its side and allowed to drain completely while the magnet holds the coated magnetite in the beaker.

The beaker is filled with water and stirred mechanically for 2 minutes. The coated particles are collected by the magnet as before, the water siphoned out, then the particles are allowed to drain as before. This process should be repeated twice more or until the wash water is colorless and free of suspended solids.

The precipitation, coating and washing process is repeated, and both lots of coated magnetite are combined in a single 4 liter beaker. The beaker is filled with acetone to the 3 liter mark and the mixture is stirred for 30 minutes using a 3 blade propellar driven by a variable speed motor. The coated particles are collected over a magnet, acetone is siphoned from the beaker and the beaker is tipped on its side to allow as much acetone as possible to drain off, using the magnet to hold the particles in the beaker. This process is repeated using another 3 liter portion of acetone.

The acetone-dried particles are placed in a 2 liter enameled pan, and warmed gently on a hot plate while air is blowing over the surface of the pan to evaporate the acetone. After the acetone has been evaporated, a total of 1 liter of heptane is added to the dry powdery coated magnetite. The mixture is heated and stirred by hand. Heptane is added to the pan to replace heptane lost by evaporation and the mixture is heated until an internal temperature of 95° C. is reached. During heating acetone and water are ordinarily evolved. It is not known exactly where all the water comes from but it is possible that some water is absorbed on the magnetite surface and is evolved only when the temperature of the magnetite reaches 65°–70° C.

The heptane suspension is allowed to cool to about 60° C., then it is poured into a pan placed over a magnet. The slurry contains some solid magnetic material which is not stabilized by oleic acid. It is collected over the magnet so that the yield of stabilized magnetite can be measured. The enameled pan is rinsed with heptane to transfer all the solids to the pan over the magnet which is now covered with aluminum foil to minimize evaporation of heptane. The heptane suspension is allowed to stand undisturbed for 1 hour.

B. Treating the Coated Particles with Petroleum Sulfonate Salt Dispersant

The heptane suspension is mostly removed from the pan without moving the pan off the magnet by scooping it out using a 150 ml. beaker. The heptane suspension is filtered back into the enameled pan. The liquid remaining in the pan is also poured through a filter. The agglomerated material has a fairly large size so that it is not necessary to use a fine filter. Without moving the pan off the filter, the solids in the pan are washed with 5 consecutive 200 ml. portions of heptane, each portion of heptane poured out of the pan through the filter. The solids in the pan are then allowed to dry thoroughly and weighed to determine the yield of coated magnetite. The theoretical yield is 547 g. (462 g. of magnetite and 85 g. of oleic acid). The actual yield of product stabilized in heptane is about 82–85%.

The filtered heptane suspension is heated in a stream of air to evaporate the heptane.

In each of 2 separate 600 ml. beakers is weighed 200 g. of PETROSUL 750 produced by Penreco Co. Heptane is then added to make 500 ml. total volume. The mixture is heated and stirred by hand to dissolve the PETROSUL 750 and heated to an internal temperature of 90° C. These solutions are added to the filtered heptane suspension as space becomes available. The heptane suspension is evaporated to a final volume of about 1 liter, the liquid is poured into a 4 liter beaker, and heptane is added to adjust the volume to 1 liter.

The heptane suspension is allowed to cool to about 50° C. Then, 2 liters of acetone are then added as rapidly as possible with vigorous mechanical stirring using a 3 blade propeller for 5 minutes. Then the slurry is scooped out of the 4 liter beaker with a 150 ml. beaker in about 5 equal portions, sequentially, and poured into an 8-inch by 8-inch by 2-inch aluminum pan placed on a magnet. The liquid is poured off and the particles over the magnet are squeezed as dry as possible using a spatula.

The magnetic particles are placed in an enameled pan, 1 liter of heptane is added and the mixture is heated to an internal temperature of 95° C. The heptane suspension is placed in a 4 liter beaker, the volume adjusted to 1 liter with heptane and, after cooling, the particles are precipitated with acetone as before. Bench experiments show that the excess dispersant as well as the mineral oil carrier are soluble in a 2:1 by volume solvent mixture of acetone and heptane. Two precipitations are sufficient to remove the undesirable excess dispersant and oil as long as the particles over the magnet are squeezed as dry as possible each time.

The particles collected over the magnet are now placed in an 8-inch by 8-inch by 2-inch aluminum pan.

C. Preparation of the Finished Magnetic Colloid

The coated particles are suspended in about 500 ml. of heptane and the pan is placed on a hot plate and warmed with air blowing over the surface of the pan to evaporate acetone. Heptane is added to replace that which is evaporated. When an internal temperature of 70° C. has been reached, the desired volume of 6 cst. poly(alpha olefin) oil is added. A volume of 350 ml. of 6 cst. oil is most desirable. It is preferable to use only a small volume of the 6 cst. oil in this stage of the preparation so that a high magnetization fluid (i.e. greater than 400 gauss) is prepared. The pan is then heated strongly to an internal temperature of 130°–135° C. and maintained at this temperature for 45 minutes with air blowing over the surface to complete the evaporation of heptane.

The pan is then placed over a magnet in an oven heated to 70° C. and allowed to remain there for not less than 12 hours. Without removing the pan from the magnet, as much fluid as possible is poured out of the pan through a filter. When this fluid has gone through the filter, the pan is taken off the filter and the liquid is quickly poured into the filter. The 6 cst. oil is a poorer solvent than heptane and consequently it will not stabilize the large particles which are stabilized in the heptane. These particles agglomerate and are strongly held by the magnet. However, a considerable volume of useful magnetic colloid is also held by the magnet. Taking the pan off the magnet allows this fluid to be poured out of the pan and into the filter. This fluid also carries with it a substantial amount of agglomerated material which tends to plug the filter and cause it to run slowly. It is quicker and more efficient to filter this fluid last, after the highly refined product has been poured off and filtered.

The base fluid can be diluted to any desired magnetization by adding the proper amount of 6 cst. oil. It is very important, however, to carefully mix the liquid. Small quantities (up to about 300 ml.) can be mixed by hand. Larger quantities should be mixed using a mechanical stirrer and mixing for a minimum of 30 minutes after heating the fluids to 70° C.

EXAMPLE I

PREPARATION OF A MAGNETIC FLUID USING A LOWER MOLECULAR WEIGHT SULFONIC ACID SALT DISPERSANT

In a 2 liter beaker was placed 470 ml. of 42° Bé ferric chloride solution, 400 ml. of water, and 278 g. of ferrous sulfate heptahydrate. The mixture was stirred to dissolve the iron salt.

In a 4 liter beaker was placed 400 ml. of water and 600 ml. of ammonia solution. With vigorous stirring the solution of the iron salts were added over a 30-second period to precipitate magnetite.

The mixture was stirred for 15 minutes. Then, 50 ml. of oleic acid was added and the mixture was stirred for an additional 15 minutes. Then the 4 liter beaker was filled with cold water and 53 ml. of heptane was added and stirred to coagulate the coated magnetite.

The coated material settled rapidly to the bottom of the beaker and it was retained by a magnet while the supernatant liquid was drained. The solids were washed by decantation utilizing cold water and draining as before. The washing process was repeated 3 times.

The above process was repeated and the 2 batches of coated magnetite were combined and stirred with 3 liters of acetone. The solids were collected over a magnet and the acetone was drained as completely as possible. This process was repeated with an additional 3 liter quantity of acetone.

The acetone damp solids were placed in a stainless steel beaker, heptane was added and the slurry was heated to 80° C. to remove acetone. A 500 ml. quantity of xylene was added and the mixture was heated to an internal temperature of 110° C. in order to remove the water. The suspension was placed in an aluminum pan covered and the pan was placed over a magnet overnight.

Two 600 ml. beakers were prepared with 200 g. each of PETROSUL 745 (Penreco Co.) and heptane was added to make a volume of 500 ml. The mixture was heated and stirred to an internal temperature of 90° C.

The heptane/xylene suspension of oleic acid coated magnetite was filtered into a pan and heated to evaporate the fugitive solvent. The solution of PETROSUL 745 in heptane was added as space became available, and the mixture was heated and evaporated to a 1 liter volume. The fluid was cooled and placed in a 4 liter beaker. With vigorous stirring, 2 liters of acetone were added to precipitate the coated particles. The particles were collected over a magnet and as much liquid as possible was removed. The particles were placed in a pan, 1 liter of heptane was added and heated to an internal temperature of 80° to evaporate residual acetone. The heptane suspension was cooled, again placed in a 4 liter beaker and the particles were precipitated by adding 2 liters of acetone with vigorous stirring. The particles were again collected over a magnet and as much liquid as possible was removed. The particles were suspended in heptane, heated to remove acetone, then 350 ml. of a 6 cst. poly(alpha olefin) oil was added. The mixture was heated in a shallow pan to an internal temperature of 150° C. to evaporate heptane. The slurry was placed in a shallow pan over a magnet in an oven heated at 90° C. for 24 hours. The liquid was filtered from the very substantial amount of solid which remained in the pan. The filtered fluid did respond to a magnet, indicating that it was a stable magnetic fluid.

The quantity of solid which was removed from the fluid by refining over a magnet was significantly greater than the quantity of solid which was removed when PETROSUL 750 was used as the dispersant. This Example shows that the lower molecular weight sulfonic acid salt has a shorter oil soluble tail and can stabilize only smaller particles.

EXAMPLE II

PREPARATION OF A MAGNETIC FLUID UTILIZING AN 8 CST OIL CARRIER

In a 2 liter beaker was placed 470 ml. of 42° Bé ferric chloride solution and 400 ml. water. To this was added 278 g. of ferrous sulfate heptahydrate and the mixture was stirred to dissolve the iron salt.

In a 4 liter beaker was placed 400 ml. of water and 600 ml. of 26° Bé ammonia. With vigorous stirring, the iron salts were added over a 30-second period and the mixture was stirred for about 15 minutes. After stirring for 15 minutes, 50 ml. of oleic acid was added and the mixture was stirred for an additional 30 minutes while the slurry was heated to 75° C. The beaker was filled with cold water, and 53 ml. of heptane was added. The mixture was stirred for an additional 3 minutes; then the solids were collected in the bottom of the beaker over a magnet. The water was removed as completely as possible, and the precipitated particles were washed with 3 separate 4 liter quantities of cold water. The solids were collected over a magnet each time and the water was removed as completely as possible. The above process was repeated again and the washed coated magnetite was combined in a 4 liter beaker. The magnetite was stirred with a 3 liter quantity of acetone, the solids collected over a magnet, and the acetone was removed as completely as possible. This process was repeated with an additional 3 liter quantity of acetone.

The acetone wet particles were placed in a shallow pan, 500 ml. of xylene was added, and the mixture was heated to an internal temperature of 140° C. to remove acetone and water. The slurry was cooled and about 500 ml. of heptane was added to suspend as much of the solid as possible. The slurry was placed in a pan over a magnet and allowed to stand for 1 hour.

The fluid was filtered into a shallow pan and the solids in the pan over the magnet were rinsed with heptane as previously described in Section B of the Detailed Procedure.

In 2 separate 600 ml. beakers were placed 200 g. of PETROSUL 750, and heptane was added to make a volume of 500 ml. The mixture was heated and stirred to an internal temperature of 90° C.

The filtered suspension of coated magnetite in heptane/xylene was heated to evaporate heptane and the heptane solution of the PETROSUL 750 was added as space became available. The mixture was evaporated at an internal temperature of 100° C. to a volume of about 1 liter.

The mixture was placed in a 4 liter beaker, cooled, and with vigorous stirring 2 liters of acetone was added to precipitate the particles. The precipitated particles were collected over a magnet and as much liquid as possible was removed. The particles were then taken up in about 1 liter of heptane and heated to evaporate residual acetone. The cooled suspension was placed in a 4 liter beaker and with vigorous stirring, again 2 liters of acetone was added to precipitate the particles which were collected over a magnet and as much liquid as possible was removed.

The precipitated particles were suspended in 1 liter of heptane, heated to an internal temperature of about 70° C. to evaporate acetone, and 350 ml. of 8 cst. poly (alpha olefin) oil was added. The mixture was heated in a shallow pan to an internal temperature of 130° C. to evaporate heptane. The mixture was placed in a shallow pan over a magnet in a 70° C. oven overnight.

A considerable quantity of particles separated over the magnet. The liquid was filtered to remove agglomerated particles. It was quite responsive to a magnet indicating that a stable magnetic fluid had been formed.

This Example shows that the higher molecular weight, higher viscosity poly(alpha-olefin) oil is a poorer solvent for the dispersant tail than the lower molecular weight lower viscosity 6 cst. poly(alpha olefin) oil. As a consequence, even though the coating acid and the petroleum sulfonate were identical, the 8 cst. oil contains magnetic particles with a smaller average magnetic particle diameter than the particles which can be suspended in the 6 cst. oil.

EXAMPLE III

PREPARATION OF A MAGNETIC FLUID UTILIZING MYRISTIC/OLEIC ACID COATED MAGNETITE

In a 2 liter beaker was placed 470 ml. of 42° Bé ferric chloride solution, 400 ml. of water, and 278 g. of ferrous sulfate heptahydrate. The mixture was stirred to dissolve the iron salt.

In a 4 liter beaker was placed 400 ml. of water and 600 ml. of 26° Bé ammonia solution. With vigorous stirring, the iron salts were added to the ammonia solution then stirred for 15 minutes.

In a 600 ml. beaker was placed 29.9 g. of myristic acid and 12.8 g. of oleic acid. This corresponds to a mixture of 30 volume per cent oleic acid and 70 volume per cent myristic acid. The beaker containing the acid mixture was placed on a hotplate and the acid mixture warmed until the solid acid melted and mixed with the liquid oleic acid. To this mixture was added 350 ml. of water and 50 ml. of 26° Bé ammonia solution. The mixture was stirred and heated to an internal temperature of about 80° in order to completely dissolve the acids.

With vigorous stirring, the hot solution of the organic acids in the ammonia solution was added to the precipitated magnetite and stirring was continued for 20 minutes. Next, 53 ml. of heptane was added and stirring was continued for 5 minutes until all the coated magnetite had coagulated as a granular mass on the bottom of the beaker.

The coated magnetite was held on the bottom of the beaker with a magnet while the water was removed as completely as possible. Fresh cold water was added to a 4 liter volume, the mixture was stirred, the solids were collected on the bottom of the beaker and the water was drained as completely as possible. This procedure was repeated twice for a total of 3 washings.

The entire above procedure was repeated and the coated magnetite obtained from the two procedures were combined in a 4 liter beaker. A 3 liter volume of acetone was added, the mixture was stirred for approximately 15 minutes, and the magnetite was collected over a magnet at the bottom of the beaker. The acetone was drained as completely as possible. This procedure was repeated with an additional 3 liter quantity of acetone.

The acetone wet particles and 500 ml. of heptane was added. The mixture was heated and additional heptane was added to a volume of 1 liter. The mixture was heated to an internal temperature of 95° C., the fluid was cooled, and placed in a shallow pan over a magnet and covered overnight. The fluid was filtered into a shallow pan and the residue remaining over the magnet was washed 5 times with 200 ml. portions of heptane and again filtered. Surprisingly, only a small quantity of residue remained in the pan.

In 2 separate 600 ml. beakers was placed 200 g. of PETROSUL 750 and heptane was added to a volume of 500 ml. The mixture was stirred and heated to an internal temperature of 90° C.

The heptane solution of the PETROSUL 750 was added to the filtered heptane suspension of oleic/myristic acid coated magnetite and the mixture was heated to an internal temperature of 90° C. and allowed to evaporate to a 1 liter volume. The liquid was cooled and placed in a 4 liter beaker. With vigorous stirring a 2 liter volume of acetone was added to precipitate the particles. The particles were collected over a magnet and as much liquid as possible was drained from the beaker.

The particles were suspended in heptane and heated to remove residual acetone. The liquid was cooled, placed in a 4 liter beaker and the volume adjusted to 1 liter with heptane. With vigorous stirring, the particles were precipitated by adding a 2 liter quantity of acetone. The precipitated particles were collected over a magnet as before and as much liquid as possible was removed from the beaker.

The precipitated particles were suspended in 1 liter of heptane and heated to an internal temperature of about 70° C. to evaporate acetone. A volume of 350 ml. of 6 cst. poly(alpha olefin) oil was added and the mixture was placed in a shallow pan and heated to an internal tempertaure of 130° C. to evaporate heptane. The fluid was placed in a shallow pan over a magnet in the 70° C. oven overnight.

The liquid was filtered after standing over the magnet in the 70° C. oven for 24 hours. A very substantial quantity of magnetic solid was retained over the magnet.

The filtered liquid was placed in a clean shallow pan and again placed over the magnet in the 70° C. oven to remove any additional particles which may be too large to form a stable suspension in the 6 cst. oil.

After an additional 24 hours, the product was filtered. Only a small additional quantity of solid was retained over the magnet. The fluid responded well to a magnet indicating that a stable magnetic fluid had been obtained.

This Example shows that the maximum particle size magnetic solid that can be suspended in a stable magnetic fluid can be controlled by selecting a relatively short chain acid to coat the precipitated magnetite.

EXAMPLE IV

PREPARATION OF A MAGNETIC FLUID UTILIZING MAGNETITE COATED WITH PALMITIC/OLEIC ACID

In a 2 liter beaker was placed 470 ml. of 42° Bé ferric chloride solution and 400 ml. of water, and 278 g. of ferrous sulfate heptahydrate. It was warmed and stirred to dissolve the iron salt.

In a 600 ml. beaker was placed 15 ml. of oleic acid and 35 ml. of palmitic acid corresponding to 12.8 g. of oleic acid and 29.7 g. of palmitic acid. This mixture corresponds to 30 volume per cent oleic acid and 70 volume per cent palmitic acid. The mixed acids were heated to melt the palmitic acid and mix them, then they were dissolved in a solution of 350 ml. water and 50 ml. of 26° Bé ammonia solution. The mixture was heated to an internal temperature of about 80° C. to produce a clear aqueous solution.

In a 4 liter beaker was placed 400 ml. of water and 600 ml. of 26° Bé ammonia solution. With vigorous stirring, the iron salts were added to the ammonia solution over a 30-second period. The mixture was stirred for about 15 minutes, then the ammonia solution of the organic acids was added and the mixture stirred for an additional 15 minutes. Next, 53 ml. of heptane was added and the mixture was stirred for 10 minutes to coagulate the coated magnetite. The solids were collected over a magnet and the liquid drained off as completely as possible. The solids were washed with 4 liter quantities of water, collecting the solids on the bottom of a beaker over a magnet and removing the water as completely as possible. The process was repeated until the wash water was clear and free of suspended solids.

The above procedure was repeated twice, then the two batches were combined in a 4 liter beaker, and the beaker filled with acetone to the 3 liter mark and stirred for about 1 hour.

The solids were collected over a magnet, the acetone was siphoned off and drained as completely as possible. Another 3 liter quantity of acetone was added to the coated magnetite particles and stirred for 30 minutes. The magnetic solids were collected over a magnet, the acetone siphoned off, and then drained as completely as possible. The acetone wet particles were placed in a shallow pan and heated gently to evaporate acetone.

A 1 liter quantity of heptane was added and heated to an internal temperature of 90° C. to evaporate residual acetone and water. The slurry was cooled, poured into a shallow pan, and placed over a magnet where it was allowed to stand for 1 hour.

The fluid was then filtered back into a shallow pan and the solids remaining in the pan over the magnet were washed with five 200 ml. portions of heptane without removing the pan from the magnet.

In separate 600 ml. beakers was placed 200 g. of "PETROSUL 750" and heptane to a volume of 500 ml. The mixture was stirred and heated to an internal temperature of 90° C.

The filtered heptane suspension of coated magnetite was heated to 90° C. to evaporate heptane and the solution of the "PETROSUL 750" was added as space became available and excess heptane was evaporated to a final volume of about 1 liter. It was cooled and then poured into a 4 liter beaker and the final volume adjusted to 1 liter with heptane.

With vigorous stirring, 2 liters of acetone was added to precipitate the particles. The particles were collected over a magnet and as much as liquid as possible was removed from the beaker. About 1 liter of heptane was added to the particles which were warmed to evaporate residual acetone. The liquid was stirred vigorously and again 2 liters of acetone were added to precipitate the particles. The particles were again collected over a magnet and as much liquid as possible was removed from the beaker.

The particles were suspended in 1 liter of heptane, heated to evaporate acetone and when an internal temperature of 90° C. was reached, 350 ml. of 6 cst. oil was added. The mixture was placed in an 8-inch by 8-inch by 2-inch shallow pan and heated to an internal temperature of 135° C. to evaporate heptane. The fluid in the pan was placed in an oven over a magnet at 70° C. overnight.

The fluid was filtered from a very substantial quantity of magnetic material which was too large to be suspended in the 6 cst. oil and which was retained over the magnet. The filtered fluid was placed back in a clean pan over the magnet in a 70° C. oven overnight to remove any unstable particles which may have not been removed previously. The fluid following the second refining process was filtered from only a very small amount of solid which collected on the magnet.

This Example again demonstrates that the maximum particle size suspended by a petroleum sulfonate salt dispersant in a hydrocarbon oil carrier can be controlled by selecting a coating acid with a relatively short chain length.

EXAMPLE V

PREPARATION OF SUPER PARAMAGNETIC FLUID

In a 2 liter beaker was placed 470 ml. of 42° Bé Ferric chloride solution and 400 ml. of water. To this was added 278 g. of ferrous sulfate heptahydrate and the mixture was stirred to dissolve the iron salt.

In a 4 liter beaker was placed 400 ml. of water and 600 ml. of 26° Bé ammonia. With vigorous stirring the iron salt solution was added and stirring was continued for 15 minutes.

To the vigorously stirred magnetite suspension was then added 50 ml. of oleic acid and stirring was continued for 30 minutes. A quantity of 53 ml. of heptane was added and the mixture was stirred for 15 minutes to allow the coated magnetite to coagulate. The beaker was placed over a magnet to collect the magnetite and the water was drained as completely as possible. The beaker was filled with 4 liters of water, stirred, and the magnetite was collected over a magnet as before. The water was decanted as completely as possible.

This washing procedure was repeated three more times.

The above procedure was repeated and the two batches of coated magnetite were combined in one 4 liter beaker. The beaker was filled with 3 liters of acetone and the slurry was stirred for 30 minutes. The particles were collected over a magnet and the acetone was removed as completely as possible.

The process was then repeated using an additional 3 liter quantity of acetone and the particles were collected as before. The acetone was removed as completely as possible.

The acetone wet particles were placed in a shallow enameled pan and 500 ml. of xylene was added and the mixture was stirred and heated to an internal temperature of 120° C. to evaporate residual water and acetone.

The slurry was cooled and placed in a shallow pan over a magnet for 1 hour. The pan was rinsed with heptane to remove all solids from the enameled pan into the pan over the magnet. The total volume was about 1 liter.

The heptane/xylene suspension was filtered back into a shallow pan and the solids over the magnet were washed 5 times with 200 ml. portions of heptane and the fluids were combined.

In 2 separate 600 cc beakers was placed 200 grams of Witco Company "PETRONATE CR" and heptane was added to each beaker to give a volume of 500 ml. The mixture was then heated and stirred to an internal temperature of 90° C.

The stable heptane/xylene coated magnetite slurry was heated to an internal temperature of 90° to evaporate excess solvent and the heptane solution of the "PETRONATE CR" solution was added as space became available. Evaporation was continued until a volume of about 1000 ml. was achieved.

The suspension of coated magnetite which had been treated with petroleum sulfonate was cooled and placed in a 4 liter beaker. To this vigorously stirred suspension was added 2 liters of acetone to precipitate the coated particles. The particles were collected over a magnet and as much liquid as possible was removed. The particles were again suspended in 1 liter of heptane and heated to an internal temperature of 70° C. to evaporate acetone. The cooled suspension was placed in a 4 liter beaker, the volume was adjusted to 1 liter with heptane, and with vigorous stirring 2 liters of acetone was added to again precipitate the particles. The particles were again collected over a magnet and as much liquid as possible was removed.

The particles were suspended in a 1 liter volume of heptane and the mixture was warmed to an internal temperature of 70° C. to evaporate acetone. A 350 ml. quantity of a 6 cst. oil was added and the mixture was heated to an internal temperature of 145° C. to evaporate heptane. The magnetic fluid was then placed in a shallow pan over a magnet in an oven at 70° C. and maintained for 18 hours.

The magnetic fluid was filtered from a small amount of particles which had been attracted to the magnet. These particles were too large to be stabilized by the "PETRONATE CR" petroleum sulfonate in the 6 cst. oil. The filtered fluid responded well to a magnet indicating that it was a stable magnetic fluid.

EXAMPLE VI

PROCESS FOR TREATING MAGNETITE WITH A CHELATING AGENT TO DISSOLVE VERY SMALL PARTICLES

In a 2 liter beaker was placed 470 ml. of 42° Bé ferric chloride solution, 400 ml. of water, and 278 g. of ferrous sulfate heptahydrate. The beaker was stirred until the ferrous sulfate salt dissolved.

In a 4 liter beaker was placed 1100 ml. water and 340 g. of sodium hydroxide. The mixture was stirred to dissolve the sodium hydroxide.

With vigorous stirring the solution of iron salts was added to the sodium hydroxide solution over a 30 second period, and stirring was continued for 15 minutes after the addition of the iron salt.

In a 1 liter beaker was place 270 gr. of "Hampol Crystals" (W. R. Grace Co., trisodium N-hydroxyethylethylenediamine triacetate) and water to make a final volume of 900 ml. The beaker was stirred to dissolve the crystals and 140 g. of sulfuric acid (98%) was added to provide the acid form of the chelating agent, i.e. N-hydroxyethyl N,N',N'-ethylenediamine triacetic acid. This solution was added to the precipitated magnetite and the mixture was allowed to stir overnight after water was added to make a 4 liter volume.

The beaker was placed over a magnet to collect the magnetite and the deep red supernatant liquid was siphoned off leaving approximately 1500 ml. water remaining. The beaker was filled with cold water stirred, and allowed to stand over a magnet to collect the magnetite. The water was then siphoned out to a volume of 1500 ml.

This process was repeated 8 times in order to remove by-product inorganic salts and chelated iron.

The entire process was repeated again and both batches of magnetite were combined and dried.

The precipitation will generate 231 g. or 1.0 mole of magnetite. The acidified chelating agent solution is sufficient to dissolve 25% of the precipitated magnetite. Since two batches of magnetite were treated and combined the expected yield was 346.5 g. of magnetite. The actual yield was 312 g. or 90% of the expected quantity of magnetite.

This example demonstrates that a chelating agent for iron in the acid form will dissolve and remove magnetite.

EXAMPLE VII

USE OF AN EQUAL WEIGHT MIXTURE OF OLEIC AND ISOSTEARIC ACID AS COATING ACIDS FOR MAGNETITE

In a 600 ml. beaker was placed 25 g. of oleic acid and 25 g. of isostearic acid. The acids were mixed, heated and stirred. Then 350 ml. of water and 50 ml. of 26° Bé ammonia were added and the mixture was heated until the acids dissolved.

In a 2 liter beaker was placed 465 ml. of 42° Bé $FeCl_3$ solution, 400 ml. of water and 278 g. of ferrous sulfate heptahydrate. The mixture was stirred to dissolve the iron salt.

In a 4 liter beaker was placed 400 ml. of water and 600 ml. of 26° Bé ammonia. With vigorous stirring the solution of iron salts was added. The mixture was stirred until a smooth dispersion of $Fe_3O_4$ was formed, then the aqueous ammonia solution of the mixed organic acids was added. The mixture was stirred for 10 minutes, then 53 ml. of heptane was added. Stirring was continued for an additional 15 minutes. The solids were settled over a magnet, the supernatant liquid was carefully removed, and the solids were washed 5 times with cold water by decantation.

Three liters of acetone was added to the water wet solids and the mixture was stirred for 15 minutes. The magnetic solids were collected over a magnet and the acetone carefully drained. The procedure was repeated with an additional 3 liter quantity of acetone.

The solids were placed in an enamelled pan with 1 liter of heptane, and heated to 97° C. to evaporate acetone and residual water. The resulting suspension was cooled, placed in a pan over a strong magnet and allowed to stand overnight.

The heptane suspension was mostly removed from the pan without moving the pan off the magnet by scooping it out using a 150 ml beaker. The heptane suspension was filtered back into the enamelled pan. Without moving the pan off the magnet, the solids in the pan were washed with 5 consecutive 200 ml. portions of heptane, each portion of heptane poured out of the pan through the filter. The solids in the pan were allowed to dry thoroughly and were weighed to determine the yield of coated magnetite in suspension. The theoretical highest possible yield was 281 g. The solids remaining in the pan that did not form a stable suspension in heptane weighed 27.7 g. The yield of stabilized magnetite in suspension was therefore 90%.

The heptane suspension of particles coated with oleic/isostearic acids was heated in a stream of air to evaporate heptane and a solution of 200 g. of the sodium salt of an alkylated aromatic sulfonic acid (Petrosul 750) in a total volume of 500 ml. was added to the heptane suspension. The heptane suspension was heated at 97° C. and evaporated to a volume of approximately 1 liter.

The heptane suspension of coated particles, which had been treated with the sodium salt of the alkylated aromatic sulfonic acid, was cooled and an equal volume (1 liter) of acetone was added with vigorous stirring. The resulting slurry of particles in acetone/heptane was poured into a pan over a magnet to collect the magnetic particles. The supernatant liquid was poured off and the particles were squeezed as dry as possible using a spatula. The particles were resuspended in heptane, and heated to approximately 97° C. to evaporate acetone and excess heptane to give a final volume of approximately one liter. The particles were taken out of suspension by addition of 1 liter of acetone as before, and the separated particles were collected over a magnet and squeezed as dry as possible.

The magnetic particles were suspended again in 1 liter of heptane and heated to 97° C. to completely remove the acetone. A quantity of 175 ml. of a 6 cst. poly(alpha olefin) oil was added and the mixture was heated to approximately 135° C. in air to evaporate the heptane.

The colloidal suspension of magnetic particles in the 6 cst. oil was poured into an 8-inch X 8-inch X 2-inch aluminum pan which was placed over a magnet in an oven heated at 70° C. and held there for about 12 hours. Heating the colloid to 70° C. reduced the viscosity of the carrier thereby increasing the mobility of the particles. Particles which were too large to form a stable colloid in the 6 cst. oil were attracted to the magnet and held strongly in the bottom of the pan.

Without removing the pan from the magnet, as much fluid as possible was poured out of the pan through a filter. When this fluid had gone through the filter, the pan was taken off and the liquid was quickly poured into the filter. Particles that were too large to form a stable suspension in the 6 cst. oil agglomerated into clusters which were retained by the filter. Only a small quantity of agglomerated particles were removed from the finished fluid and a stable suspension was obtained.

It has been found that combinations of acids may be used to control the particles size distribution of magnetic particles in fugitive solvents and carrier liquids. For instance, careful selection of coating acid combinations may be used to provide stable colloids in carrier liquids of low volatility in which the average magnetic particle size is comparable to the average magnetic particle size of colloids with carrier liquids which are better solvents but that have higher volatility.

Experience has shown, for instance, that a mixture of arachidic acid and behenic acid (arachidic/behenic acid) does not peptize magnetic particles spontaneously into heptane. A mixture of arachidic and behenic acids has been used because the mixture is readily available commercially. One would also expect that neither arachidic acid or behenic acid alone would peptize magnetic particles into heptane. The arachidic/behenic acid mixture used was Hystrene 9022 produced by Witco Corporation. In one embodiment, the arachidic/behenic acid mixture was used with oleic acid to form a combination of acids for coating magnetic particles. A stable suspension of coated particles was formed in heptane when the arachidic/behenic acid mixture made up to about 70% of the combination of acids and oleic acid made up the remaining percentage of the combination of acids.

The use of an arachidic/behenic acid mixture in combination with oleic acid, or another acid which peptizes magnetic particles into a fugitive solvent spontaneously, is of particular interest because the longer chain acids, arachidic and behenic acids, enable one to maintain a particle size distribution in an 8 cst. oil that is comparable to the particle size distribution in a 6 cst. oil in which only oleic acid is used as the coating acid.

Using an 8 cst. oil rather than a 6 cst. oil is advantageous because the 8 cst. oil is a less volatile carrier liquid than a 6 cst. oil. Using a combination of the arachidic/behenic acid mixture and oleic acid therefore provides a colloid which has a lower evaporation rate (lower volatility), resulting in a longer-lived (more stable) colloid. Similar results would be expected from a combination of arachidic acid and oleic acid or behenic acid and oleic acid. Comparable results would also be expected if oleic acid was replaced by a different acid which will peptize magnetic particles into fugitive solvents and carrier liquids such as isostearic acid, linoleic acid or linolenic acid.

This phenomena apparently occurs because the longer chain acids peptize larger particles into the carrier liquids than do shorter chain acids. It is understood, of course, that the acid coated magnetic particles have been treated with a salt of an aromatic sulfonic acid before they are suspended in the carrier liquid. By providing a particle size distribution in the 8 cst. oil that is comparable to the particle size distribution in a 6 cst. oil, the saturation magnetization of the colloid in the 8 cst. oil is comparable to the saturation magnetization of the colloid in 6 cst. oil.

To describe the use of a combination of an arachidic/behenic acid mixture and oleic acid and the characteristics of the resulting colloids more fully, Table 1 and the ensuing discussion are provided. Table 1 summarizes data showing that a combination of an arachidic/behenic acid mixture with oleic acid or isostearic acid peptizes magnetic particles into heptane to form a stable suspension. Table 1 also shows that the arachidic/behenic acid mixture alone does not peptize magnetic particles into heptane. The "% Yield" data shows the percentage of starting magnetic particles that go into stable suspension. The experimental methods used to derive the data in Table 1 are described in more detail in Example VIII.

EXAMPLE VIII

PREPARATION OF A HEPTANE SUSPENSION OF MAGNETITE COATED WITH A MIXTURE OF ACIDS

The data presented in Table 1 was obtained utilizing the following method.

In a 2 liter beaker was placed 278 g. of ferrous sulfate heptahydrate, 470 ml. of 42° Bé $FeCl_3$ solution, and 400 ml. of water. The mixture was stirred and heated to 30° C. to dissolve the iron salts.

In a 4 liter beaker was placed 600 ml. of 26° Bé ammonia solution and 400 ml. of water and with vigorous stirring the solution of iron salts was added and stirring was continued until a smooth dispersion of magnetite was formed.

In a 600 ml. beaker was weighed the quantity of each acid in the ratios indicated in Table 1 so that the total volume of organic acid was 50 ml. The mixture of acids was heated until the solid acids were melted, then 350 ml. of water and 50 ml. of 26° Bé ammonia was added and stirring and heating was continued until a clear solution was obtained. If necessary, an additional 100 ml. of water was added to convert the "soap" gel, formed initially when the ammonia and organic acids were combined, to a clear solution, also called a "soap" solution.

As soon as a smooth dispersion of magnetite was formed, the "soap" solution was added and stirred for approximately 15 minutes. The 4 liter beaker was then filled with cold water and 53 ml. of heptane was added with vigorous stirring. The stirring was continued for 15 minutes until the coated magnetite coagulated and collected on the bottom of the beaker.

The coated magnetite was held on the bottom of the beaker by a magnet while the supernatant liquid was drained completely. The coated magnetite was washed 5 times by decantation with cold water until the wash water was clear and free of suspended material. Water was drained from the coated magnetite as completely as possible, then 3 liters of acetone was added and the mixture was stirred vigorously for 10 minutes. The coated magnetite was allowed to settle and again retained by a magnet at the bottom of the beaker while the acetone was drained. This process was repeated with an additional 3 liter quantity of acetone.

The acetone wet solids were placed in an enamelled pan and 1 liter of heptane was added. The mixture was heated to 97° C. to evaporate acetone and residual water. The heptane suspension of coated magnetite was poured into an aluminum pan over a magnet and any solids remaining in the enamelled pan were rinsed into the aluminum pan with heptane. The aluminum pan was placed on a magnet and allowed to stand undisturbed for 1 hour.

As much of the heptane suspension as possible was scooped out of the pan with a 150 ml. beaker and the heptane suspension was filtered. The residual solids in the pan were washed with 5 consecutive 200 ml. portions of heptane, and the washings were removed by pouring the liquid through a filter without removing the pan from the magnet. The solids remaining in the pan were dried carefully and weighed. The yield of coated magnetite in suspension was determined by subtracting the quantity of solids in the pan from the total weight of coated magnetite (magnetite plus coating acid).

A relatively low yield of magnetite in stable suspension was obtained using a combination of 70% of a arachidic/behenic acid mixture and 30% oleic acid. A substantial quantity of jelly-like material was retained by the magnet even after the fifth washing with 200 ml. of heptane.

TABLE 1

| Acid | Vol % of Acid in the Combination of Acids | | | | | | | | | | |
|---|---|---|---|---|---|---|---|---|---|---|---|
| Arachidic/ behenic | 70 | | 70 | 100 | | | | 30 | 30 | 40 | 60 |
| Oleic | | | 30 | | 30 | 30 | 100 | | 70 | 60 | 40 |
| Isostearic | 30 | 100 | | | | | | 70 | | | |
| Palmitic | | | | | 70 | | | | | | |
| Myristic | | | | | | 70 | | | | | |
| % Yield | 67.4 | 83 | 67 | 0 | 85 | 92.6 | 85 | 68.4 | 86.3 | 81.3 | 83.7 |

The data showing a 68.4% yield when a combination of 30% arachidic/behenic acid mixture and 70% isostearic acid is used is unexpectedly low and probably resulted from experimental error. The yield for this combination of acids is typically comparable to the yield resulting from use of oleic acid instead of isostearic acid.

In accordance with the process of the present invention, after a stable suspension of magnetic particles is formed in the fugitive solvent, in this instance heptane, the stable suspension is treated with a salt of an aromatic sulfonic acid, a dispersant, before the coated magnetic particles are dispersed in hydrocarbon oil. Preferably, alkylated aromatic sulfonic acid salts are used to treat the stable suspension of magnetic particles.

After the particles are treated with the dispersant, they are placed in a carrier liquid. When particles coated with a combination of an arachidic/behenic acid mixture (60%) and oleic acid (40%) were treated with one of the above identified dispersants and placed into an 8 cst. oil carrier liquid, a stable colloid was formed which slowly gelled into a thermally reversible gel at room temperature. This is shown in the following Examples IX, X and XI. This material has properties which make it of interest for a variety of applications. For many uses, however, such as most sealing applications, it is preferred to have a stable colloid which remains a liquid at room temperature.

Experimentation also showed that stable colloids were formed as liquids at room temperature in 8 cst. oil when the arachidic/behenic acid mixture content of the coating acid combination was from about 30% to about 40% and the oleic acid content of the coating acid combination was from about 70% to about 60%. This is shown in the following Example XII.

Using a combination of an arachidic/behenic acid mixture and oleic acid to coat magnetic particles may provide useful colloids when the arachidic/behenic acid mixture content ranges from about 1% to about 70% and the oleic acid content ranges from about 30% to about 99%. For most sealing applications, the most useful colloids are ordinarily those which are stable liquids at room temperature. Such colloids may be formed when the arachidic/benenic mixture makes up from about 1% to about 40%, preferably from about 10% to about 40% of the combination of coating acids and the oleic acid content ranges from about 60% to about 99%, preferably from about 60% to about 90%.

Isostearic acid, linoleic acid and linolenic acid are expected to provide substantially the same results obtained with oleic acid when they are used in the percent composition ranges described above for oleic acid. In addition, use of behenic acid or arachidic acid rather than an arachidic/behenic acid mixture is expected to provide substantially the same results as the mixture of arachidic and behenic acids when they are used in the percent composition ranges described above for an arachidic/behenic acid mixture.

EXAMPLE IX

PREPARATION OF A MAGNETIC COLLOID UTILIZING 60% ARACHIDIC/BEHENIC ACID MIXTURE AND 40% OLEIC ACID AS THE COATING ACID COMBINATION WITH A VERY HIGH MOLECULAR WEIGHT ALKYLATED AROMATIC SULFONIC ACID SALT IN AN 8 CST. OIL

In a 600 ml. beaker was placed 30 g. of an arachidic/behenic acid mixture and 20 g. of oleic acid. The combination of acids was heated on a hot plate to melt the solid arachidic/behenic acid mixture and mix it with the liquid oleic acid. Then 350 ml. of water and 50 ml. of 26° Bé ammonia solution were added and heated to form a uniform smooth gel. An additional 100 ml. of water were added to form a clear "soap" solution and not a gel.

In a 2 liter beaker was placed 278 g. of ferrous sulfate heptahydrate, 400 ml. of water, and 465 ml. of 42° Bé $FeCl_3$ solution. The mixture was stirred to dissolve the iron salt.

In a 4 liter beaker was placed 600 ml. of 26° Bé ammonia solution and 400 ml of water. With vigorous stirring the iron salt solution was added and stirring was continued until a smooth uniform dispersion of magnetite was formed.

The hot "soap" solution was next added and stirred. Stirring was continued for 15 minutes. Then, 53 ml. of heptane was added and the stirring continued to form a coagulated mass of coated magnetite. The particles were collected over a magnet, the salt solution was siphoned out and the salts removed as completely as possible. The coagulated solids were washed 5 times with 4 liter portions of cold water,each time retaining the coated magnetite over a magnet while the water was drained as completely as possible. Then, a 3 liter portion of acetone was added and stirring was continued for 15 minutes. The coated magnetite was collected in the bottom of the beaker over a magnet, and the acetone was drained as completely as possible. This procedure was repeated with an additional 3 liter quantity of acetone.

The acetone wet solids were placed in an enamelled pan with 1 liter of heptane and heated to 97° C. to evaporate acetone and any residual water. The heptane suspension was poured into an aluminum pan and residual solids in the enamelled pan were rinsed into the aluminum pan with heptane. The aluminum pan was placed over a magnet for 1 hour.

The stable heptane suspension of coated magnetite was filtered into an enamelled pan and the solids remaining in the aluminum pan were washed with 5 consecutive 200 ml. portions of heptane, the wash liquid also being poured through the filter. Into this pan was added 100 g. of "STEP-AD 63" (high molecular weight alkylated aromatic sulfonic acid salts produced by Stepan Chemical Company) and the mixture was heated at 97° C. to evaporate heptane and reduce the total volume to approximately 1 liter. The cooled heptane suspension of coated magnetite containing "STEP-AD 63" was placed in a 4 liter beaker and a volume of 2 liters of acetone was added with vigorous stirring to coagulate the coated magnetite particles. The slurry was poured into an aluminum pan held over a magnet, the clear supernatant liquid was poured off and the particles retained by the magnet were squeezed as dry as possible using a spatula.

The coated particles were then taken up in 1 liter of heptane, heated to 97° to evaporate acetone, cooled and the particles were separated by the addition of 2 liters of acetone. The solids were collected as before and squeezed as dry as possible. The collected solids were suspended in a 1 liter volume of heptane, and heated to a 97° C. to evaporate acetone. 175 ml. of 8 cst. oil (EMERY 3008 produced by Emery Industries, Inc.) was added and the mixture was heated to 130° C. to evaporate heptane. The fluid was placed in a aluminum pan over a magnet in an oven maintained at 70° C. for 12 hours. The warm fluid easily went through a filter but rapidly turned to a gel as it cooled to room temperature.

A colloid stability test utilizing 5 ml. of fluid maintained in an aluminum dish over a strong samarium cobalt magnet at 70° C. demonstrated that this was a stable colloid. There was no evidence of separation of carrier liquid. It appears that this combination of constituents forms a colloid which is a stable liquid at elevated (60°-70° C.) temperatures but forms a thermally reversible gel at room temperature.

The colloid stability test is conducted as follows. A 5-8 ml. quantity of magnetic colloid is placed in a small aluminum dish placed over a cylindrical samarium cobalt magnet approximately 1 inch in diameter and one half inch high. The magnet and dish are placed in an oven maintained at 60°-80° C. for 24 hours. The elevated temperature reduces the carrier viscosity and increases particle mobility.

At the end of this time the colloid is examined. An unstable colloid will show a separation of either clear liquid carrier or a very weakly magnetic liquid, and the mass of magnetic material will remain conformed to the magnetic field. Removing the magnet leaves a solid mass or an extremely viscous liquid remaining in the area above the magnet.

A stable colloid will show no separation of carrier liquid and when the magnet is removed from the bottom of the dish the colloid will pour out of the dish easily. Only a small circle of solid will remain in the aluminum dish outlining the edge of the cylindrical magnet.

The magnetic colloid of Example IX can be useful in special applications. The colloid prepared using "STEP AD 63" was refined over a magnet at 60°-70° C. and filtered easily. However, it set to a very high viscosity solid on cooling to room temperature (21° C.). At 25° C. the viscosity of the colloid was over 2000 cp., much higher than the expected maximum value of about 1000 cp. A similar product was obtained using over twice the quantity of dispersant proving that a sufficient quantity of dispersant had initially been supplied. A very high viscosity at "low" temperatures (i.e. less than about 25° C.) greatly reduces the rate of migration of the magnetic particles in the presence of a strong magnetic field gradient. Then, when the high viscosity fluid is warmed it becomes a mobile liquid which will present only a small drag torque when used in a rotary seal. A colloid such as this will show excellent apparent stability when it is maintained for long periods of time statically in a magnetic field gradient.

EXAMPLE X

PREPARATION OF A COLLOID UTILIZING MAGNETITE PARTICLES COATED WITH 60% ARACHIDIC/BEHENIC ACID MIXTURE AND 40% OLEIC ACID, AND TREATED WITH ALOX 2292 (CALCIUM SALTS OF AN ALKYLATED AROMATIC SULFONIC ACID) IN AN 8 CST. OIL

In a 600 ml. beaker was placed 30 g. of an arachidic/behenic acid mixture and 20 g. of oleic acid. The acids were heated and stirred to melt the solid acid and mix well with the oleic acid. Then 350 ml. of water and 50 ml. of 26° Bé ammonia solution were added.

In a 2 liter beaker was placed 400 ml of water and 465 ml. of 42° Bé $FeCl_3$ solution. To this was added 278 g. of ferrous sulphate heptahydrate and the mixture was stirred and heated to dissolve the iron salt.

In a 4 liter beaker was placed 400 ml. of water and 600 ml. of 26° Bé ammonia solution. With vigorous stirring, the solution of iron salts was added to the ammonia and stirring was continued until a smooth fluid dispersion of magnetite was obtained.

The mixture of organic acids with water and ammonia was heated to approximately 90° C. to form a smooth solution of the ammonia salts of the acids. This hot "soap" solution was added to the magnetite and stirred for 15 minutes to form a smooth dispersion of coated magnetite. Then, 53 ml. of heptane were added and the mixture stirred for an additional 15 minutes to coagulate the coated magnetite.

The solids were collected on the bottom of the beaker by a magnet under the beaker, and the supernatant liquid was drained as completely as possible. The collected solids were washed with 5 portions of cold water each 4 liters in volume. The coated magnetite was retained on the bottom of the beaker with the magnet while each portion of wash water was removed as completely as possible. Then 3 liters of acetone was added and the mixture stirred for approximately 15 minutes. The coated magnetite was collected on the bottom of the beaker by the magnet and the acetone was drained as completely as possible. The procedure was repeated with an additional 3 liter quantity of acetone.

The acetone wet solids were heated with a 1 liter quantity of heptane to 97° C. in an enamelled pan in order to evaporate acetone and any residual water. The heptane suspension of coated magnetite was poured into an aluminum pan placed over a magnet and residual solids in the enamelled pan were rinsed into the aluminum pan over the magnet by heptane. The suspension in the pan was held over the magnet for 1 hour.

The fluid in the pan was filtered back into an enamelled pan which contained 100 g. of ALOX 2292, a high molecular weight alkylated aromatic sulfonic acid salt produced by Alox Corporation. Without moving the pan from the magnet, the solids in the aluminum pan were washed with 5 consecutive 200 ml. portions of heptane which were filtered into the enamelled pan. The heptane suspension and the ALOX 2292 were stirred to dissolve the ALOX 2292 and the mixture was heated to 97° C. to evaporate heptane to a total of one liter volume.

The treated magnetite suspension was poured into a 4 liter beaker, cooled, and with vigorous stirring a 2 liter portion of acetone was added to get the coated magnetite particles out of suspension. The resultant slurry was poured into a pan over a magnet to collect the precipitated coated magnetite particles and the supernatant liquid was decanted. The particles were squeezed as dry as possible using a spatula. The coated particles were again taken up in one liter of heptane, heated to 97° C., cooled and flocculated with acetone as before. The particles were collected over a magnet and squeezed as dry as possible using a spatula.

The particles were taken up in 1 liter of heptane in an enamelled pan and heated to 97° C. to evaporate acetone. Then, 175 ml. of an 8 cst. oil (EMERY 3008 produced by Emery Industries, Inc.) was added and the mixture heated to 140° C. in a stream of air to evaporate heptane. The colloid was poured into an aluminum pan which was placed over a magnet in an oven heated at 70° C. for 12 hours.

The fluid was filtered and a stable suspension was formed which over a period of 24 to 48 hours slowly formed a skin of gelled material on the surface.

A quantity of the gel was placed in a small aluminum dish and heated to 70° C. where it liquified. The liquid was subjected to the colloid stability test which showed that a stable colloid had been formed. There was no evidence of separation of carrier liquid from the liquified gel. A stable colloid was formed which was slowly converted to a thermally reversible gel at room temperature (25° C.)

EXAMPLE XI

PREPARATION OF A MAGNETIC COLLOID UTILIZING 60% ARACHIDIC/BEHENIC ACID MIXTURE AND 40% OLEIC ACID, TREATED WITH PETROSUL 750, IN AN 8 CST. OIL

In a 600 ml. beaker was placed 30 g. of an arachidic/behenic acid mixture and 20 g. of oleic acid. The acids were heated to melt the solid acid and to mix the acids, then 350 ml. of water and 50 ml. of 26° Bé ammonia was added and the mixture was stirred and heated to dissolve the acids and form a clear smooth "soap" solution.

In a 2 liter beaker was placed 465 ml. of a 42° Bé ferric chloride solution, 400 ml. of water, and 278 g. of ferrous sulfate heptahydrate. The mixture was stirred to dissolve the iron salt.

In a 4 liter beaker was placed 400 ml of water and 600 ml. of 26° Bé ammonia solution. With vigorous stirring the solution of iron salts was added and stirring continued until a smooth dispersion of magnetite was formed. Then, the hot (90° C.) "soap" solution was added and stirred for 15 minutes. A total of 53 ml. of heptane was then added and stirring continued for an additional 10 minutes.

The coated solids were collected in the bottom of the beaker over a magnet and the supernatant liquid was poured off as completely as possible. The solids were washed 5 times each with 4 liter portions of cold water, holding the magnetic particles in the bottom of the beaker over the magnet until the wash water was free of suspended material.

The solids were next washed with a 3 liter portion of acetone by stirring for 15 minutes. The magnetic solids were collected at the bottom of the beaker over a magnet and the acetone drained as completely as possible. This procedure was repeated with an additional 3 liter quantity of acetone.

The acetone wet solids were placed in an enamelled pan, treated with 1 liter of heptane, and heated to 97° C. to evaporate acetone and any residual water. The heptane suspension of coated magnetite was poured into an aluminum pan over a magnet and the solids in the pan were rinsed into the aluminum pan with additional heptane. The heptane suspension in the aluminum pan was held over the magnet for 1 hour.

The stable heptane suspension was filtered back into the enamelled pan which contained 200 g. of Petrosul 750 (a sodium salt of an alkylated aromatic sulfonic acid.) The solids in the pan were washed with 5 consecutive 200 ml. portions of heptane which were again filtered into the enamelled pan. The solids in the pan were dried and weighed indicating that 80.4% of the magnetite had gone into a stable suspension. The mixture of the Petrosul 750 and coated magnetite was heated to 97° and heptane was evaporated to a final volume of about 1 liter. This stable heptane suspension was poured into a 4 liter beaker and cooled.

The coated magnetite was removed from suspension by the addition of 2 liters of acetone. The resulting slurry was poured into a pan over a magnet to collect the solids. The supernatant liquid was poured off, and the solids were squeezed as dry as possible using a spatula. The coated particles were taken up in an additional 1 liter of heptane, heated to 97° to evaporate acetone, then cooled and flocculated with acetone as before. The particles were collected over a magnet, the supernatant liquid was poured off, and the particles were squeezed as dry as possible with a spatula. The particles were then taken up in 1 liter of heptane, heated to 97° to evaporate acetone, and 175 ml. of an 8 cst. oil was added and the mixture heated to 140° C. to evaporate heptane.

The stable fluid was placed in aluminum pan over a strong magnet in a 60° C. oven overnight.

The fluid was filtered from a small quantity of coated magnetite which was too large to be stabilized in the 8 cst. oil. The resultant magnetic colloid slowly (over a period of 48 hours) formed a skin of gelatinous material over the surface of the stable colloid. This gelatinous skin was placed in a small aluminum pan and heated to 60° C. where it liquified completely. This liquid was subjected to a colloid stability test which showed that it was a stable colloid, i.e., there was no separation of carrier liquid.

EXAMPLE XII

PREPARATION OF A STABLE NON-GELLING COLLOID UTILIZING AN ARACHIDIC/BEHENIC ACID MIXTURE IN THE COATING ACID COMBINATION

In a 2 liter beaker was placed 278 g. of ferrous sulfate heptahydrare, 470 ml. of 42° Bé $FeCl_3$ solution, and 400 ml. of water. The mixture was stirred and heated to 30° C. to dissolve the iron salt.

In a 4 liter beaker was placed 600 ml. of 26° Bé ammonia solution in 400 ml. of water, and with vigorous stirring the solution of iron salts was added and stirred until a smooth dispersion of magnetite was obtained. This procedure was repeated to provide 2 beakers each containing a slurry of magnetite.

In a 600 ml. beaker was placed 35 g. of oleic acid and 15 g. of an arachidic/behenic acid mixture. The combination of acids was heated to melt the solid arachidic/behenic acid, then 350 ml. of water and 50 ml. of 26° Bé ammonia solution were added and the combination of acids was stirred and heated to 90° C. to form a clear "soap" solution. In a second 600 ml. beaker was placed 30 g. of oleic acid and 20 g. of an arachidic/behenic acid mixture. Again the acids were heated to melt the solid acid, then 350 ml. of water and 50 ml. of 26° Bé ammonia solution were added and the mixture stirred and heated to form a clear "soap" solution.

The hot "soap" solutions were added to the separate beakers of precipitated magnetite, and stirring was continued for 15 minutes to form a smooth suspension of coated magnetite. Then, 53 ml. of heptane was added to each beaker and stirring was continued to cause the coated magnetite to coagulate. In each beaker, the coated magnetite was collected at the bottom of the beaker by a magnet under the beaker and the supernatant liquid was poured off. The magnetite in each beaker was washed 5 times with cold water until the wash water was clear and contained no suspended solid. The coated magnetite was combined and 3 liters of acetone was added and stirred for 15 minutes. The coated magnetite was collected on the bottom of the beaker over a magnet and the acetone was drained as completely as possible. This procedure was repeated with an additional 3 liter quantity of acetone.

The acetoine wet solids were placed in an enamelled pan and 1 liter of heptane was added. The mixture was heated to 97° C. to evaporate acetone and residual water, then it was rinsed into an aluminum pan over a magnet and allowed to stand for 1 hour. The heptane suspension was filtered, and the residue in the pan was washed consecutively five times each with 200 ml. portions of heptane. The heptane suspension and rinsings were filtered into an enamelled pan which contained 350 g. of PETROSUL 750 (sodium salt of an alkylated aromatic sulfonic acid.) The mixture was heated to 97° and heptane was evaporated to a volume of 1 liter. It was rinsed into a 4 liter beaker, allowed to cool, and the coated magnetite particles flocculated by the addition of 1 liter of acetone. The flocculated particles were collected in an aluminum pan over a magnet, the supernatant liquid was decanted, and the particles were squeezed as dry as possible utilizing a spatula.

The particles were resuspended in 1 liter of heptane and heated to 97° C. to evaporate acetone. After cooling, the particles were flocculated by the addition of 1 liter of acetone, and collected over a magnet and squeezed dry as before. The particles were then suspended in 1 liter of heptane, heated to 97° C. to evaporate acetone, and 400 ml. of an 8 cst. oil was added. The mixture was heated to 140° C. to evaporate heptane, and the fluid was poured into an aluminum pan which was placed over a magnet in a 60° C. oven overnight.

The fluid was filtered from a quantity of solids which were too large to be stabilized in the 8 cst. oil but were held by the magnet in the bottom of the aluminum pan. A stable magnetic colloid in an 8 cst. oil was obtained which has shown no sign of forming a gel at room temperature.

EXAMPLE XIII

PREPARATION OF A STABLE MAGNETIC COLLOID UTILIZING OLEIC ACID COATED MAGNETITE TREATED WITH PETROSUL 750, IN AN 8 CST. OIL

In a 2 liter beaker was placed 465 ml. of 42° Bé ferric chloride solution, 400 ml. of water, and 278 g. of ferrous sulfate heptahydrate. The mixture was stirred to dissolve the iron salt. In a 4 liter beaker was placed 400 ml. of water and 600 ml. of 26° Bé ammonia. With vigorous stirring the solution of iron salts was added and stirring continued until a smooth dispersion of magnetite was formed.

A total of 50 ml. of oleic acid was added to the magnetite dispersion with vigorous stirring and stirring was continued until a smooth dispersion of oleic acid coated magnetite was formed. Then, 53 ml. of heptane was added and stirring was continued for 15 minutes until the coated magnetite had coagulated and settled to the bottom of the beaker. The coated magnetite was collected in the bottom of the beaker and held there by a magnet under the beaker while the supernatant liquid was poured off and allowed to drain as completely as possible. The coated magnetite was washed with 4 liter portions of water consecutively until the rinse water was clear of suspended solids. Each time the magnetite was held at the bottom of the beaker over a magnet while the supernatant liquid was poured off as completely as possible.

The above process was repeated to provide a second batch of magnetite coated with oleic acid and the 2 batches of coated magnetite were combined in one 4 liter beaker. A total of 3 liters of acetone was added and the mixture was stirred vigorously for 15 minutes. The coated magnetite was collected in the bottom of the beaker over a magnet while the acetone was drained off as completely as possible. This procedure was repeated with an additional 3 liter quantity of acetone.

The acetone wet solids were placed in an enamelled pan with 1 liter of heptane and heated to 97° C. to evaporate acetone and residual water. The heptane suspension of magnetite was poured into an aluminium pan placed over a strong magnet and the solids in the pan were rinsed into the aluminium pan with additional heptane. The heptane suspension was held over the magnet for 1 hour.

The heptane suspension was filtered back into the enamelled pan which contained 350 g. of Petrosul 750. Without removing the pan from the magnet, the solids were washed with 5 consecutive 200 ml. portions of heptane which were also poured through the filter and collected.

The heptane suspension of oleic acid coated magnetite with the added Petrosul 750 was heated to 97° C. to evaporate heptane. The heptane washings from the pan were added to the pan containing the Petrosul 750 as space became available. Evaporation was continued until a final volume of about 1 liter was achieved.

The heptane suspension of magnetite was then poured into a 4 liter beaker, allowed to cool, and the particles were flocculated out of suspension by the addition of a 2 liter quantity of acetone with vigorous stirring. The coated particles were collected by pouring the slurry into a pan over a magnet and decanting the clear supernatant liquid. The particles were squeezed as dry as possible using a spatula.

The coated particles were taken up in an additional 1 liter of heptane and heated to 97° C. to evaporate residual acetone. The heptane suspension was cooled and the particles were flocculated from suspension by the addition of a 2 liter quantity of acetone as before. The particles were collected in a pan held over a magnet, the supernatant liquid decanted again, and the particles squeezed as dry as possible using a spatula.

The particles were taken up in an additional 1 liter quantity of heptane and heated to a 97° C. to evaporate residual acetone. A quantity of 350 ml of an 8 cst. oil was added and the fluid was heated to 130° C. in a stream of air to evaporate heptane. The fluid was placed in a shallow pan over a magnet in a 70° C. oven overnight.

The refined fluid was filtered from a substantial quantity of particles which were too large to be stabilized in the 8 cst. oil.

A stable colloid was obtained which showed no tendency to form a gel at room temperature over a period of months.

The composition of the three colloids prepared in an 8 cst. poly(alpha olefin) oil carrier in accordance with the procedures set forth in Examples IX, X and XIII using different combinations of coating acids and aromatic sulfonic acid salt dispersants are described below:

Colloid 1 of 60 percent arachidic/behenic acids/40 percent Example X oleic acid, ALOX 2292 (neutral calcium petroleum sulfonate), EMERY 3008 8 cst. oil Colloid 2 of 60 percent arachidic/behenic acids/40 precent Example XI oleic acid, "PETROSUL 750" (sodium petroleum sulfonate), EMERY 3008 8 cst. oil Colloid 3 of 100% Oleic acid, "PETROSUL 750", Gulf 8 cst. Example XIII oil The viscosity values at 300 gauss saturation magnetization as well as the average magnetic particle sizes are shown in Table 2. The saturation magnetization value was determined at infinite field.

TABLE 2

Physical Properties of Magnetic Colloids

| Sample # | Ms. | Viscosity cp at 25° C. | Avg. Mag. Part. Size in Angstroms | Sigma |
|---|---|---|---|---|
| Colloid 1 of Example X | 300 | 190 | 83.6 | 0.385 |
| Colloid 2 of Example XI | 300 | 224 | 84.1 | 0.366 |
| Colloid 3 of Eample XII | 300 | 230 | 80.2 | 0.33 |

Ms. denotes magnetization saturation. Sigma is the standard deviation of average particle size.

The differences in viscosity between the samples is due to differences in particle size distribution.

Any of the 3 colloids may be useful for sealing applications. The choice of constituents and consequently the colloid produced by them can be based on economics influenced by factors such as the greater the yield of colloid produced in a given time, the lower the unit cost of the colloid and the sealing systems utilizing these colloids.

It is important to note the changes in viscosity of the colloid which occur as a result of only small changes in the particle size distribution. Particle size variations generally do not adversely affect the colloid stability of a properly refined colloid.

The viscosity of the colloid is the "friction" of the seal, and a high viscosity causes energy losses which result in elevated temperature operation of the seal and an increased evaporation rate of the carrier.

The seal must keep dirt particles out of the clean area that it is protecting. The value of a seal depends on its ability to exclude dirt particles under the designed pressure capacity. The pressure capacity will be maintained as long as there is a certain quantity of stable coloid in the seal. The most common cause of loss of colloid id evaporation of the carrier. Therefore, it is necessary to use a carrier liquid with as low an evaporation rate as is consistant with the other requirements of the colloid.

Exclusion seals commonly use colloids with 6 cst. oil as the carrier liquid. In magnetic colloids which use a 6 cst. oil, the viscosity cannot exceed 200 cp. at 27° C. because the drag torque will raise the temperature and consequently lower the expected seal life to unacceptable times. On the other hand, viscosities greater than 200 cp. may give unacceptably high drag.

The colloids described in Table 2 use an 8 cst. oil which has an evaporation rate less than 30% that of a 6 cst. oil. Therefore, there is no question about adequate colloid life when it is used in a seal design which would normally call for a 200 cp. state-of-the-art colloid. At the same time, a saturation magnetization value of around 250 to 300 gauss can be used to ensure that the pressure capacity of the seal always exceeds the design pressure capacity of a seal utilizing the state-of-the-art colloid.

Sample colloid 3 uses the shortest chain length coating acid (oleic acid) as well as the shortest chain length aromatic sulfonic acid dispersant. Consequently, the largest particles that can be stabilized in the 8 cst. oil are smaller than the largest particles which can be stabilized by the dispersant system in the other two colloids. This is illustrated by the fact that colloid 3 has the smallest average particle size. It also has the smallest Sigma, indicating that a narrowing of the particle size distribution did occur.

Colloid 3 has the highest viscosity of any of the 300 gauss colloids listed in Table 2. Saturation magnetization depends only on the volume of magnetite in suspension, but the viscosity of the colloid depends on the total volume of the suspended particle. The radius of the suspended particle equals the radius of the inorganic particle and the length of the dispersant oil soluble tail. The ratio of the length of the "tail" to the diameter of the inorganic particle $\delta/D$, should be as low as possible to maximize the volume of magnetic material relative to the total disperse phase volume. The ratio $\delta/D$ cannot, however, be less than about 0.2 or the magnetic colloid will flocculate.

Narrowing the particle size distribution in sample colloid 3 was achieved at the expense of the larger particles relative to those in the other two samples. Thus, colloid 3 has a higher ratio of $\delta/D$ than the other two samples. This results in a higher disperse phase volume at equivalent saturation magnetization values and shows up as a higher viscosity.

Finally, the ability to stabilize only smaller particles shows up also as a lower yield of magnetite particles in stable suspension. All 3 of the colloids described above were prepared starting with the same quantity of magnetite and carrier liquid. The acid coated magnetite was treated with a large excess of dispersant which was removed subsequently in order to assure that the particles were not "starved" for dispersant. The yield of suspended particles in sample colloid 3 was only about 70% of that achieved in sample colloid 1.

Sample colloids 1 and 2 have about the same average magnetic particle size, within experimental error. Sample colloid 2 uses a somewhat shorter chain length dispersant than sample colloid 1 and some narrowing of the particle distribution did occur as shown by the somewhat lower Sigma of sample colloid 2. This shows up as a somewhat higher viscosity in sample colloid 2, compared with sample colloid 1. Also, the yield of magnetite particles in stable suspension in sample colloid 2 was about 90% that of sample colloid 1.

It will be apparent to those skilled in the art that various modifications and variations can be made in the products and processes of the present invention without departing from the scope or spirit of the invention. Thus, it is intended that the present invention cover modifications and variations thereof provided they come within the scope of the appended claims and their equivalents.

What is claimed is:

1. A magnetic fluid comprising:

(a) a carrier liquid;

(b) a dispersing agent comprising a salt of an aromatic sulfonic acid which disperses coated magnetic particles in said carrier liquid; and (c) coated magnetic particles coated with a combination of organic acids which renders said magnetic particles hydrophobic, wherein said combination of acids comprises from about 1% to about 70% of a first acid selected from the group consisting of arachidic acid, behenic acid and a mixture of arachidic and behenic acids and from about 30% to about 99% of a second acid selected from the group consisting of oleic acid, linoleic acid, linolenic acid and isostearic acid, said combination of organic acids being capable of peptizing said magnetic particles into a fugitive solvent for said dispersing agent.

2. A magnetic fluid as recited in claim 1 wherein said first acid is a mixture of arachidic and behenic acids.

3. A magnetic fluid as recited in claim 2 wherein said second acid is oleic acid.

4. A magnetic fluid as recited in claim 2 wherein said second acid is isostearic acid.

5. A magnetic fluid as recited in claim 3 wherein said mixture of arachidic and behenic acids comprises from about 10% to about 40% of said combination of acids and said oleic acid comprises from about 60% to about 90% of said combination of acids.

6. A magnetic fluid as defined in claim 5 wherein said dispersing agent is a salt of an alkylated aromatic sulfonic acid.

7. A magnetic fluid as defined in claim 3 wherein said dispersing agent is a salt of an alkylated aromatic sulfonic acid.

8. A magnetic fluid as defined in claim 1 wherein said dispersing agent is a salt of an alkylated aromatic sulfonic acid.

9. A magnetic fluid as defined in claim 8 wherein said salt of an alkylated aromatic sulfonic acid has at least one alkyl substituent containing from 1 to 25 carbon atoms.

10. A magnetic fluid as defined in claim 8 wherein said magnetic particles have an average magnetic particle diameter from about 80 Å to about 90 Å.

11. A magnetic fluid as recited in claim 8 wherein said carrier liquid is an 8 cst. non-polar poly(alpha olefin) oil.

12. A magnetic fluid as recited in claim 6 wherein said carrier liquid is an 8 cst. non-polar poly(alpha olefin) oil.

13. A magnetic fluid as recited in claim 1 wherein said carrier liquid is an 8 cst. non-polar poly(alpha olefin) oil.

14. A process for making a magnetic fluid comprising:

(a) providing an aqueous suspension of coated magnetic particles coated with a combination of organic acids which renders said magnetic particles hydrophobic, wherein said combination of acids comprises from about 1% to about 70% of a first acid selected from the group consisting of arachidic acid, behenic acid and a mixture of arachidic and behenic acids and from about 30% to about 99% of a second acid selected from the group consisting of oleic acid, linoleic acid, linolenic acid and isostearic acid;

(b) separating said coated magnetic particles from said aqueous suspension;

(c) treating said coated magnetic particles with a solution of a dispersing agent in a fugitive solvent wherein said fugitive solvent peptizes said coated magnetic particles into a stable colloidal suspension; and (d) adding a carrier liquid to said colloidal suspension to form a stable magnetic liquid.

15. A process as recited in claim 14 wherein said first acid is a mixture of arachidic and behenic acids.

16. A process as recited in claim 15 wherein said second acid is oleic acid.

17. A process as recited in claim 15 wherein said second acid is isostearic acid.

18. A process as recited in claim 16 wherein said mixture of arachidic and behenic acid comprises from about 10% to about 40% of said combination of acids and said oleic acid comprises from about 60% to about 90% of said combination of acids.

19. A process as recited in claim 18 wherein said dispersing agent is a salt of an alkylated aromatic sulfonic acid.

20. A process as recited in claim 16 wherein said dispersing agent is a salt of an alkylated aromatic sulfonic acid.

21. A process as recited in claim 14 wherein said dispersing agent is a salt of an alkylated aromatic sulfonic acid.

22. A process as recited in claim 19 wherein said salt of an aromatic sulfonic acid has at least one alkyl substituent containing from 1 to 25 carbon atoms.

23. A process as recited in claim 21 wherein said magnetic particles have an average magnetic particle diameter from about 80 Å to about 90 Å.

24. A process as recited in claim 14 wherein said magnetic particles have an average magnetic particle diameter from about 80 Å to about 90 Å.

25. A process as recited in claim 24 wherein said carrier liquid is an 8 cst. non-polar poly(alpha olefin) oil.

26. A process as recited in claim 23 wherein said carrier liquid is an 8 cst. non-polar poly(alpha olefin) oil.

27. A process as recited in claim 14 wherein said carrier liquid is an 8 cst. non-polar poly(alpha olefin) oil.

28. A process for making a magnetic fluid comprising:

(a) precipitating magnetic particles from an aqueous solution;

(b) contacting said precipitated magnetic particles in an aqueous suspension with a combination of organic acids to provide coated magnetic particles coated with said combination of organic acids, wherein said combination of organic acids comprises from about 1% to about 70% of a first acid selected from the group consisting of arachidic acid, behenic acid and a mixture of arachidic and behenic acids and from about 30% to about 99% of a second acid selected from the group consisting of oleic acid, linoleic acid, linolenic acid and isostearic acid;

(c) adding a fugitive solvent to said coated magnetic particles in an amount sufficient to coagulate said coated magnetic particles into a water repellant granular mass and separating said coated magnetic particles from said suspension;

(d) rinsing said coated magnetic particles with water to remove by-product inorganic salts;

(e) adding additional fugitive solvent to said coated magnetic particles to form a stable suspension of magnetic particles in said additional fugitive solvent;

(f) heating said stable suspension to evaporate residual water and water associated with the surfaces of said magnetic particles;

(g) removing from said stable suspension coated magnetic particles with a particle diameter greater than that which can be stabilized by said combination of organic acids in said fugitive solvent;

(h) treating the coated magnetic particles remaining in said stable suspension with a salt of an aromatic sulfonic acid dispersing agent to form a stable colloid of said remaining coated magnetic particles;

(i) removing excess dispersant from said stable colloid;

(j) adding a carrier liquid to said stable colloid; and (k) removing said fugitive solvent from said stable colloid.

* * * * *